US008733845B2

(12) United States Patent
Bollinger

(10) Patent No.: US 8,733,845 B2
(45) Date of Patent: May 27, 2014

(54) SYSTEMS, MACHINES, DEVICES AND METHODS FOR EFFICIENTLY REMOVING SIDEWALK TRIP HAZARDS

(76) Inventor: Kevin Bollinger, Barneveld, WI (US)

( * ) Notice: Subject to any disclaimer, the term of this patent is extended or adjusted under 35 U.S.C. 154(b) by 187 days.

(21) Appl. No.: 12/855,446

(22) Filed: Aug. 12, 2010

(65) Prior Publication Data

US 2011/0037307 A1 Feb. 17, 2011

Related U.S. Application Data

(60) Provisional application No. 61/301,070, filed on Feb. 3, 2010, provisional application No. 61/233,384, filed on Aug. 12, 2009.

(51) Int. Cl.
*E01C 23/09* (2006.01)
*B28D 1/04* (2006.01)

(52) U.S. Cl.
CPC ..... *E01C 23/09* (2013.01); *B28D 1/044* (2013.01)
USPC ..... 299/39.3; 299/41.1

(58) Field of Classification Search
USPC ..... 299/36.1, 39.1, 39.2, 39.3, 39.5, 41.1; 404/87
See application file for complete search history.

(56) References Cited

U.S. PATENT DOCUMENTS 3,585,980 A 6/1971 Mellor
3,649,071 A * 3/1972 Graff ..... 299/41.1
3,697,135 A 10/1972 Hatcher
3,779,606 A 12/1973 Hatcher
3,785,705 A 1/1974 Binger
3,934,373 A 1/1976 Lellart
4,433,871 A * 2/1984 Bertrand ..... 299/41.1
4,778,304 A 10/1988 Baldi
4,792,190 A * 12/1988 Bertrand ..... 299/41.1
4,832,412 A 5/1989 Bertrand
4,958,457 A 9/1990 Doskocil
4,998,775 A 3/1991 Hollifield
5,044,696 A * 9/1991 Blackhurst ..... 299/41.1
5,116,162 A 5/1992 Burhite
5,215,071 A 6/1993 Mertes
5,429,420 A 7/1995 Johnson
5,605,381 A * 2/1997 Schmoock et al. ..... 299/39.2
5,676,125 A 10/1997 Kelly
5,680,854 A 10/1997 Kingsley
5,722,789 A 3/1998 Murray
5,724,956 A 3/1998 Ketterhagen
5,809,985 A 9/1998 Kingsley
5,857,453 A 1/1999 Caven
5,890,834 A 4/1999 Waldenberger (Continued)

*Primary Examiner* — David Bagnell
*Assistant Examiner* — Michael Goodwin
(74) *Attorney, Agent, or Firm* — Boardman & Clark LLP

(57) ABSTRACT

A trip hazard removing apparatus includes a saw head and blade connected to guide rail(s), which are connected to a support structure, which is connected to lift arm(s) of a vehicle. The vehicle moves the trip hazard removing apparatus between trip hazards occurring between upper and lower slabs of a sidewalk, placing it on the lower slab adjacent to and in contact with a trip hazard, and lifting it after removing the trip hazard. A trip hazard engaging mechanism automatically locates the saw blade's position and angle relative to and above the upper slab to create appropriate transition surface(s) between the upper and lower slabs as it cuts off the trip hazard. The guide rail(s) allow placing the saw blade facing the sidewalk's side surface. The saw head and blade are moved along the guide rail(s) across the upper slab and through the side surfaces to remove the trip hazard.

2 Claims, 14 Drawing Sheets

(56) References Cited

U.S. PATENT DOCUMENTS

| | | | | |
|---|---|---|---|---|
| 6,014,811 | A | 1/2000 | Taomo | |
| 6,158,817 | A | 12/2000 | Bertrand | |
| 6,203,112 | B1 | 3/2001 | Cook | |
| 6,227,620 | B1 | 5/2001 | Page | |
| 6,318,351 | B1 | 11/2001 | Baratta | |
| 6,394,080 | B1 | 5/2002 | Zavala | |
| 6,470,874 | B1 | 10/2002 | Mertes | |
| 6,582,026 | B2 | 6/2003 | Bertrand | |
| 6,709,064 | B2 | 3/2004 | Nettek | |
| 6,863,062 | B2 | 3/2005 | Denys | |
| 7,220,174 | B2 | 5/2007 | Phillips | |
| 7,261,623 | B1 | 8/2007 | Palushi | |
| 7,337,037 | B2 * | 2/2008 | Schaer et al. | 700/160 |
| 7,451,757 | B2 | 11/2008 | Ketterhagen | |
| 2005/0159091 | A1 | 7/2005 | Norton | |
| 2005/0263302 | A1 | 12/2005 | Newnam | |
| 2006/0127179 | A1 | 6/2006 | Nadler | |
| 2007/0116519 | A1 | 5/2007 | Haroldsen | |
| 2008/0008527 | A1 | 1/2008 | Kraemer | |
| 2008/0011138 | A1 | 1/2008 | Brazell | |
| 2008/0017182 | A1 | 1/2008 | Hilsgen | |
| 2008/0060631 | A1 | 3/2008 | Dofher | |
| 2008/0163492 | A1 | 7/2008 | Johansson | |
| 2009/0188067 | A1 * | 7/2009 | White et al. | 15/246.2 |

* cited by examiner

FIG. 1
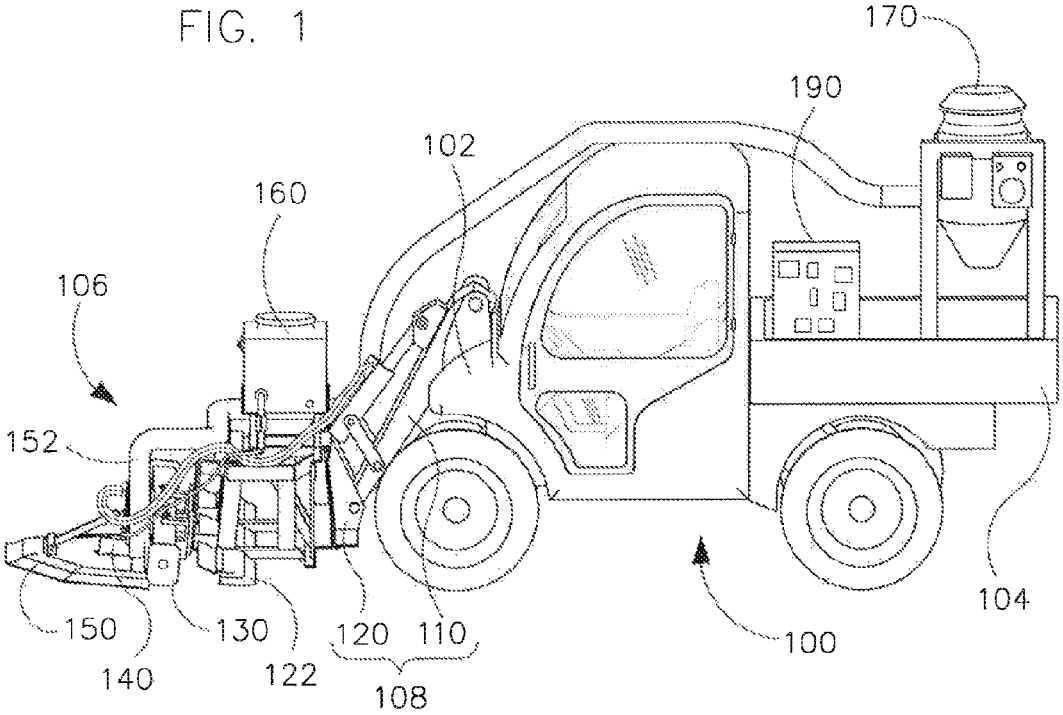
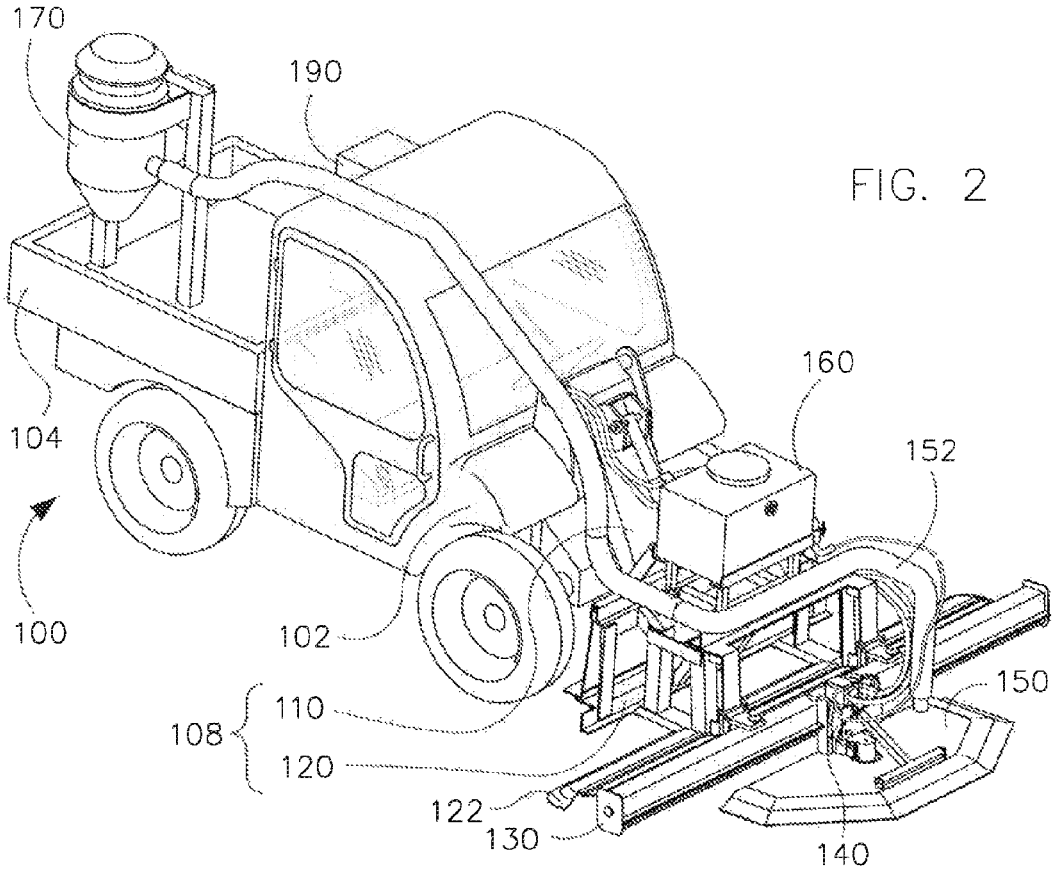
FIG. 2

FIG. 3
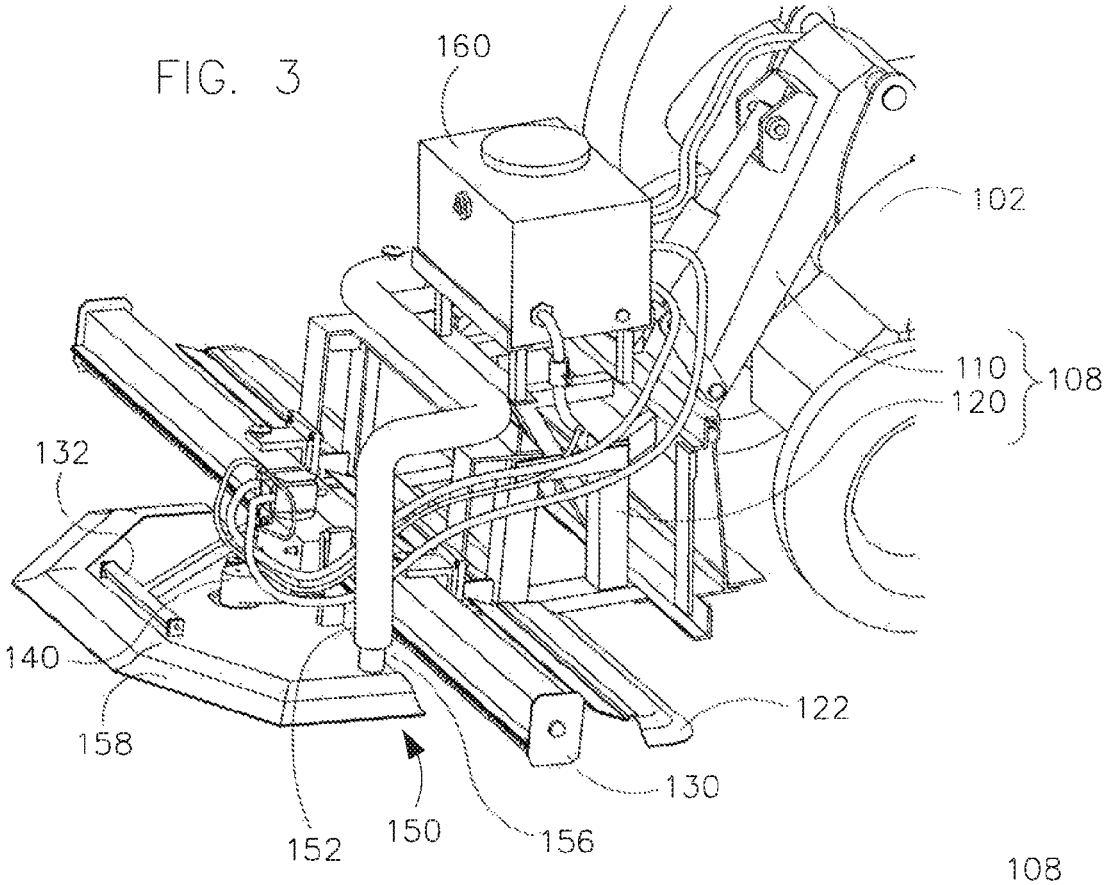
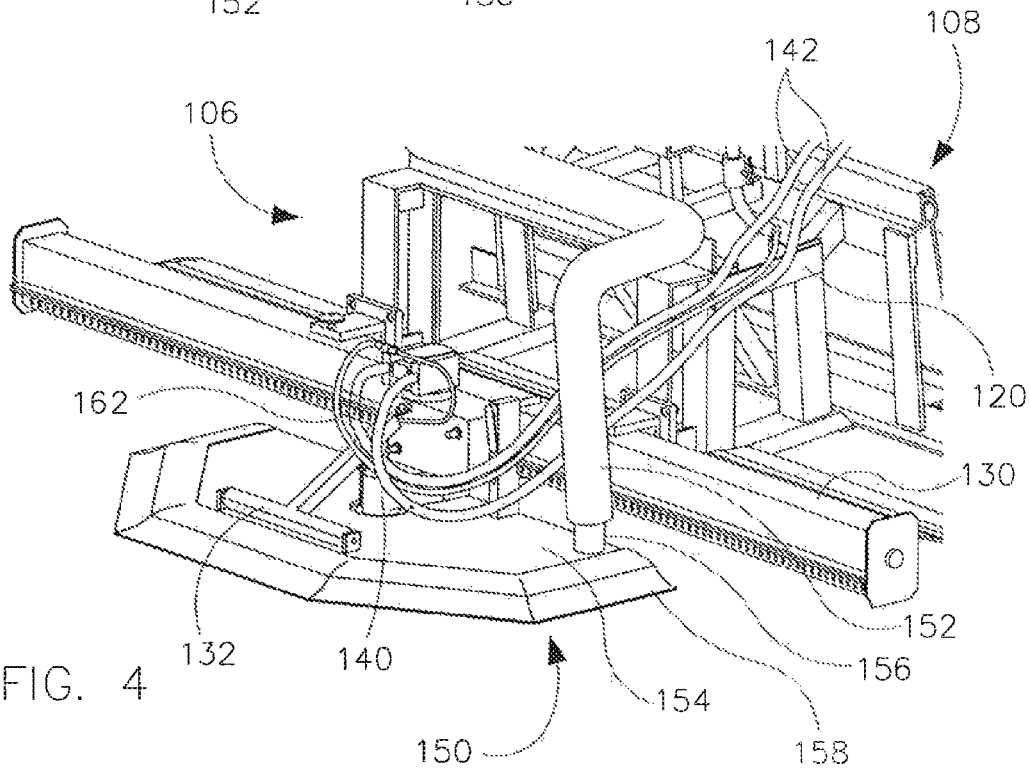
FIG. 4

FIG. 5
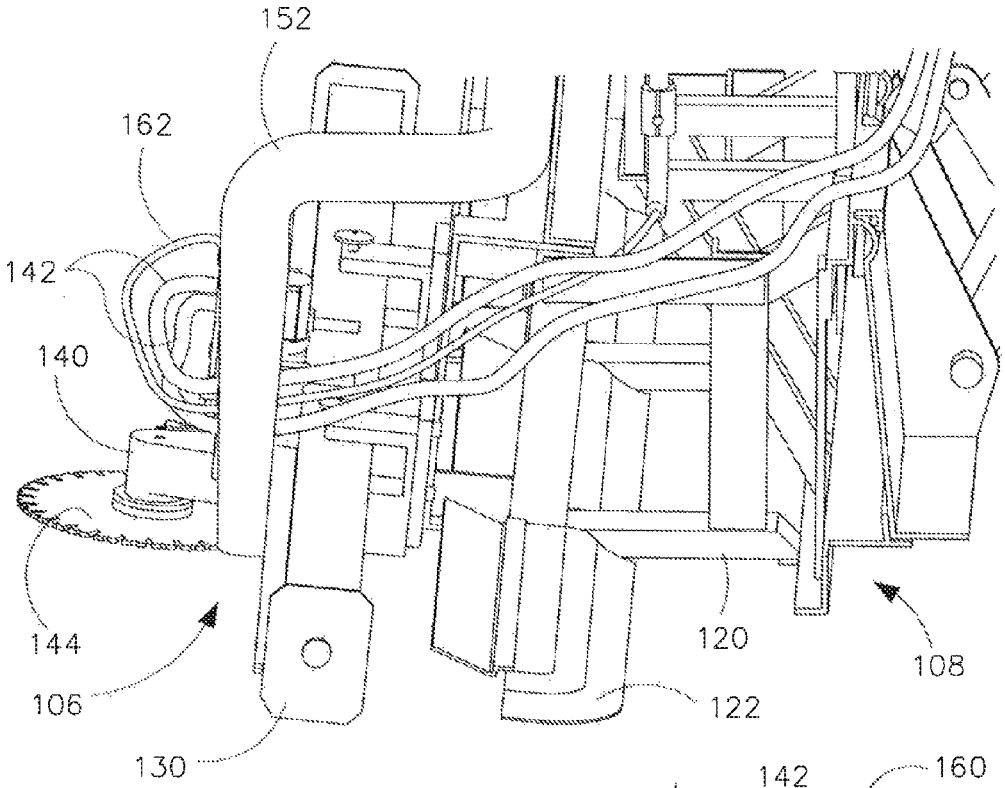
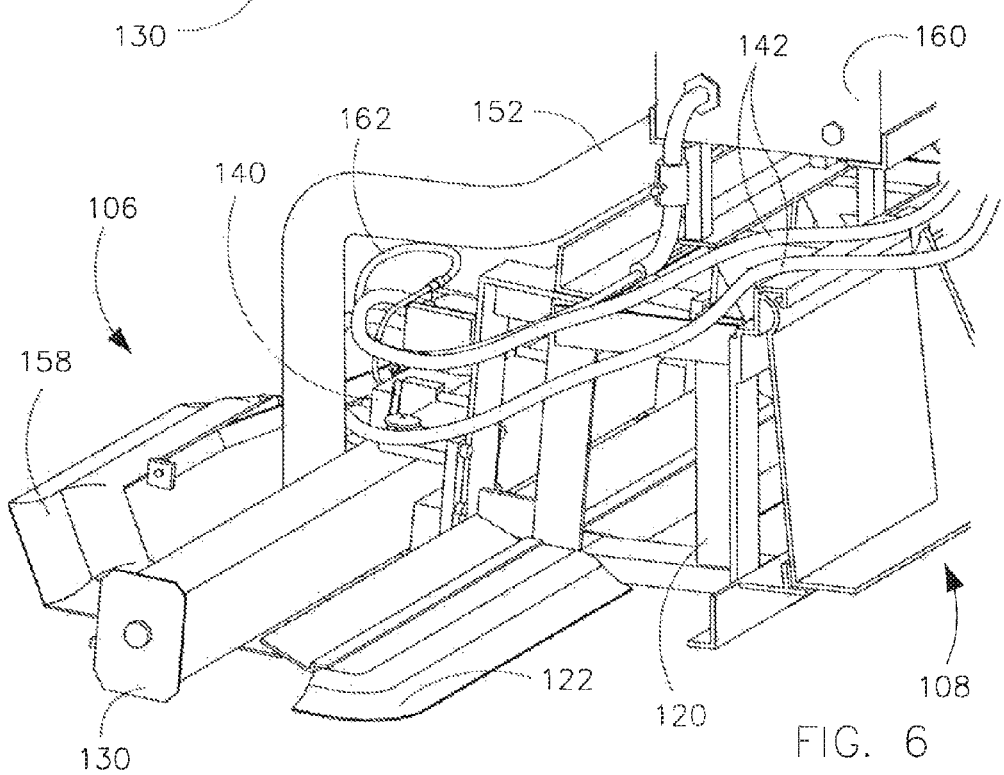
FIG. 6

FIG. 9
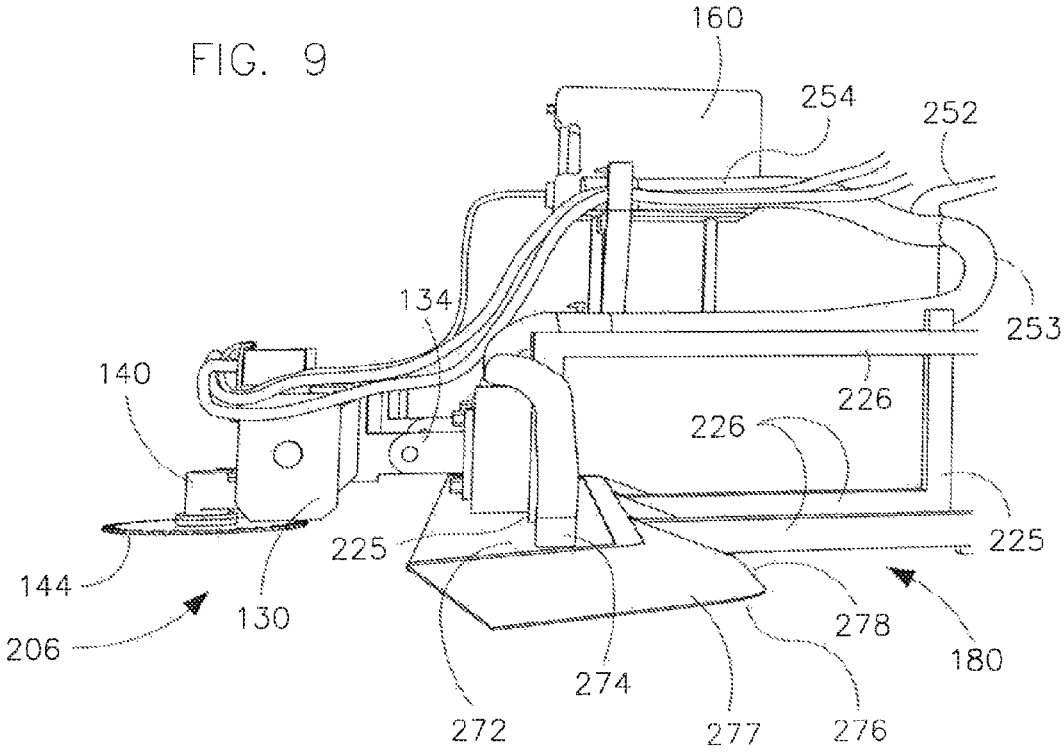
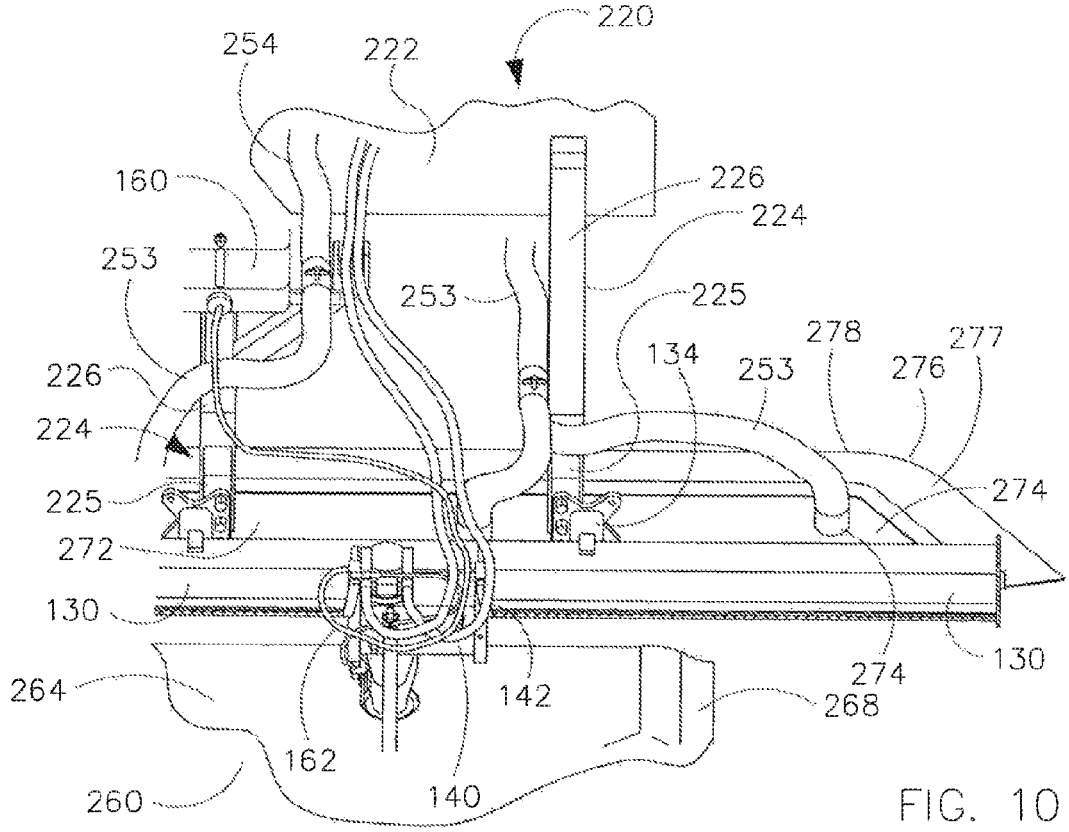
FIG. 10

FIG. 12
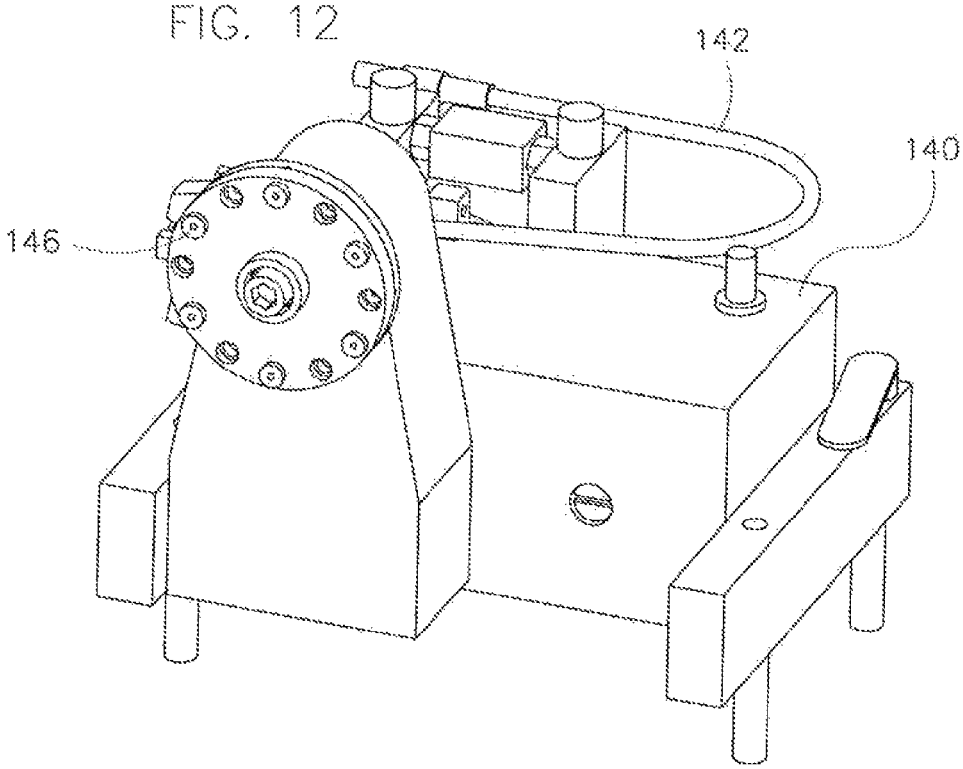
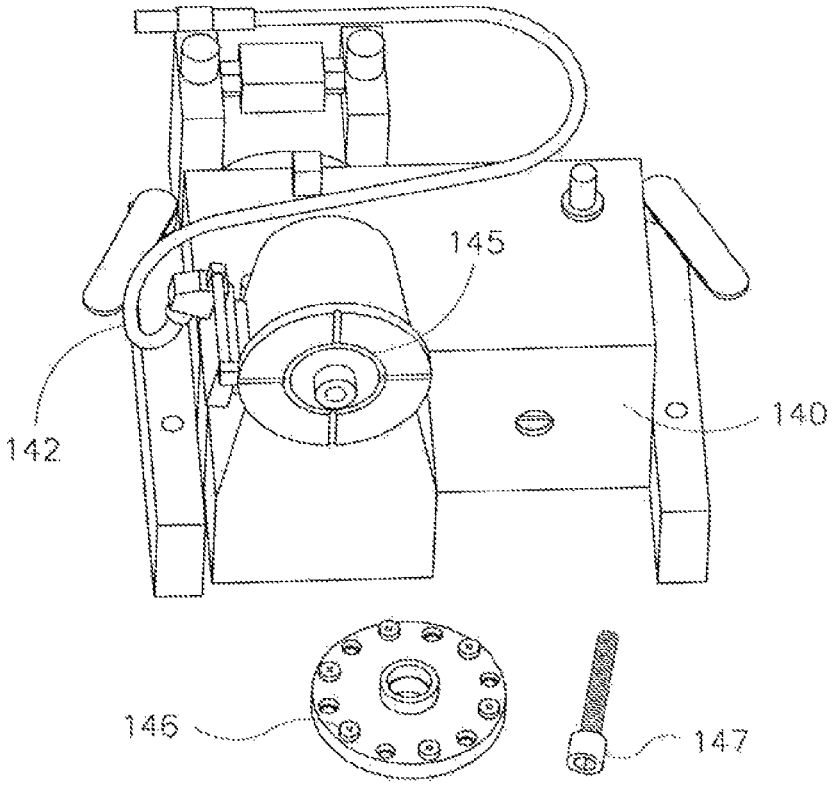
FIG. 13

FIG. 18
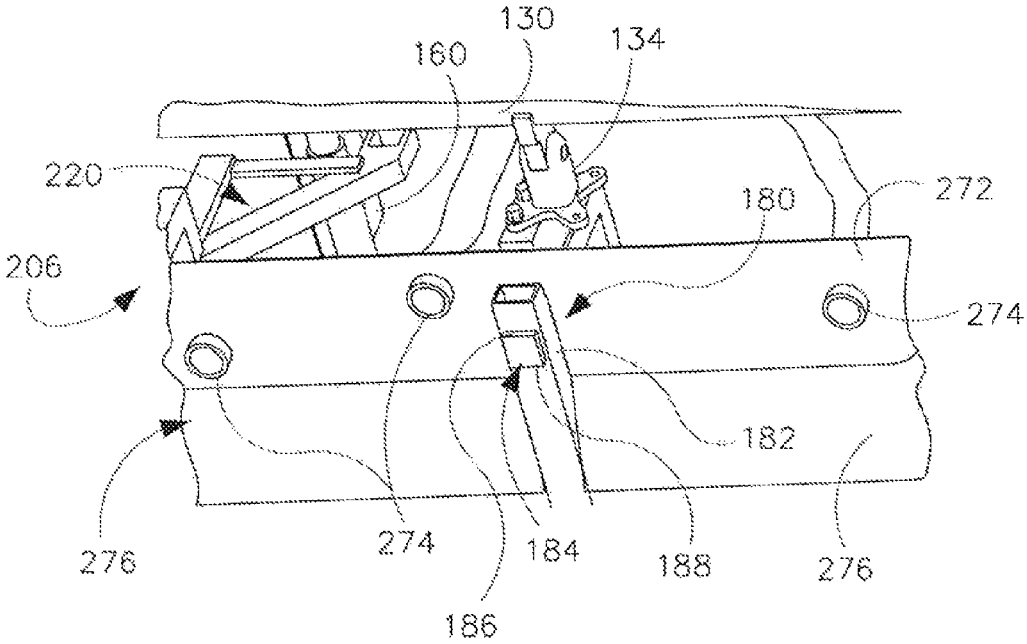
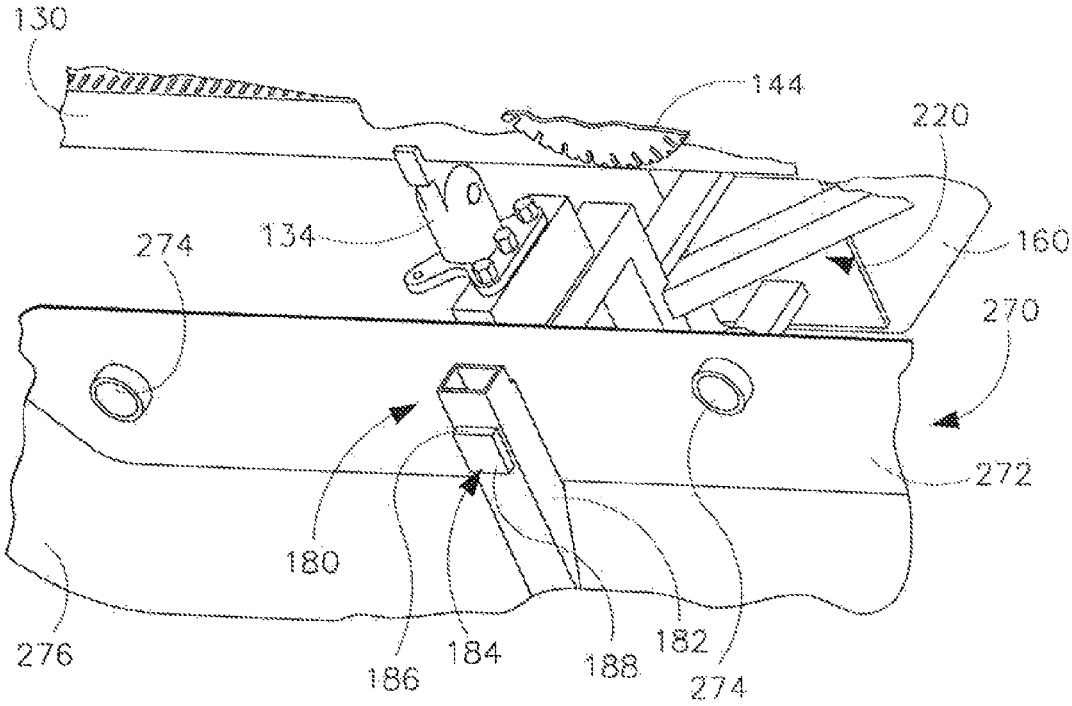
FIG. 19

FIG. 20
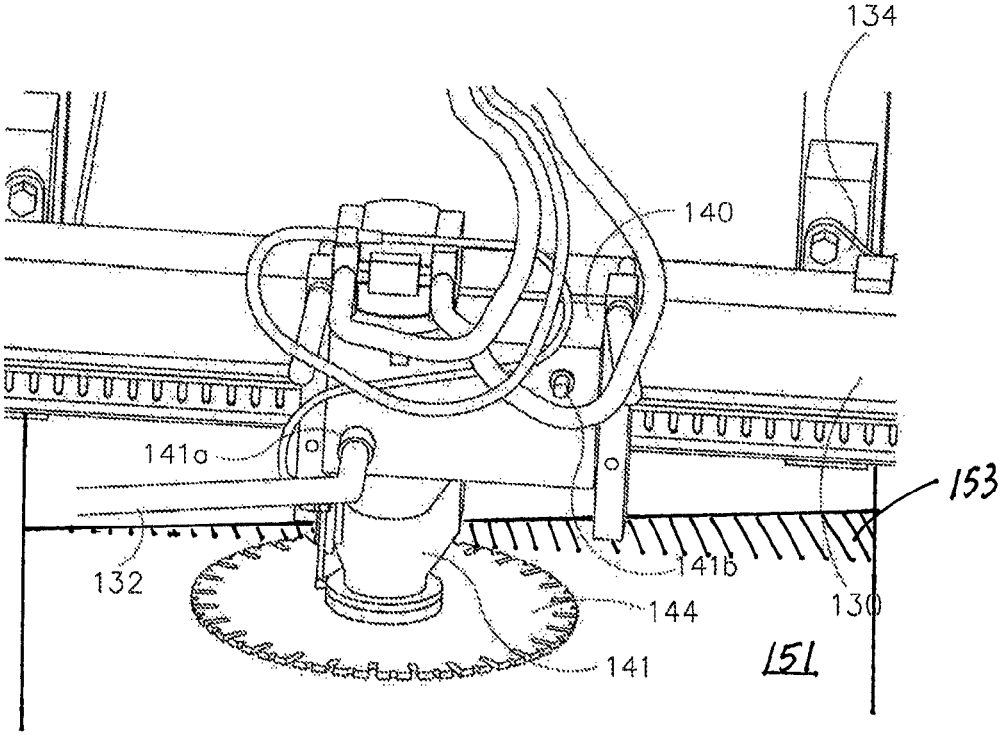
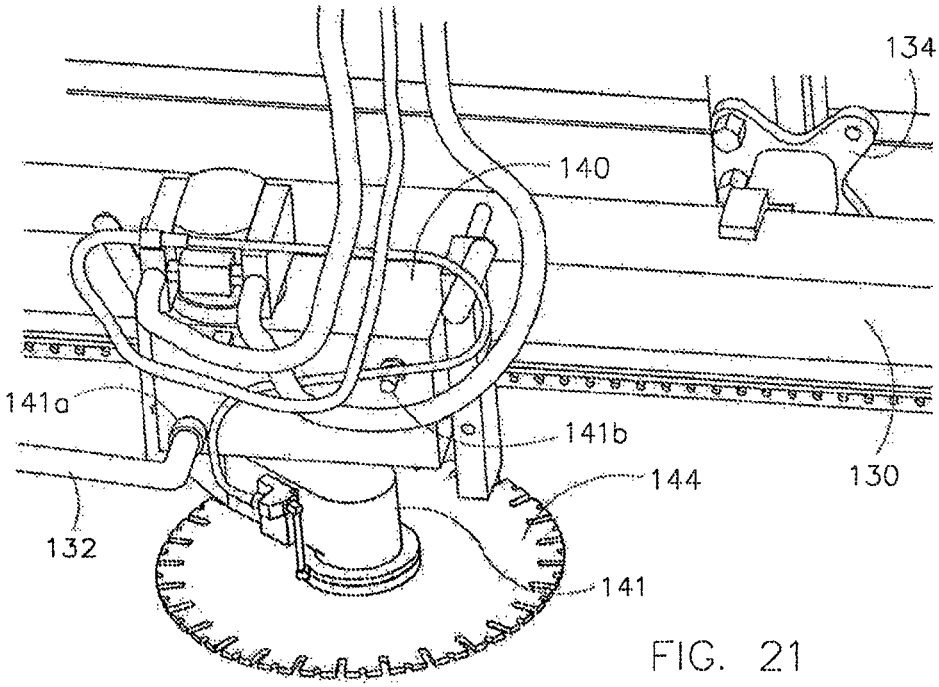
FIG. 21

FIG. 22
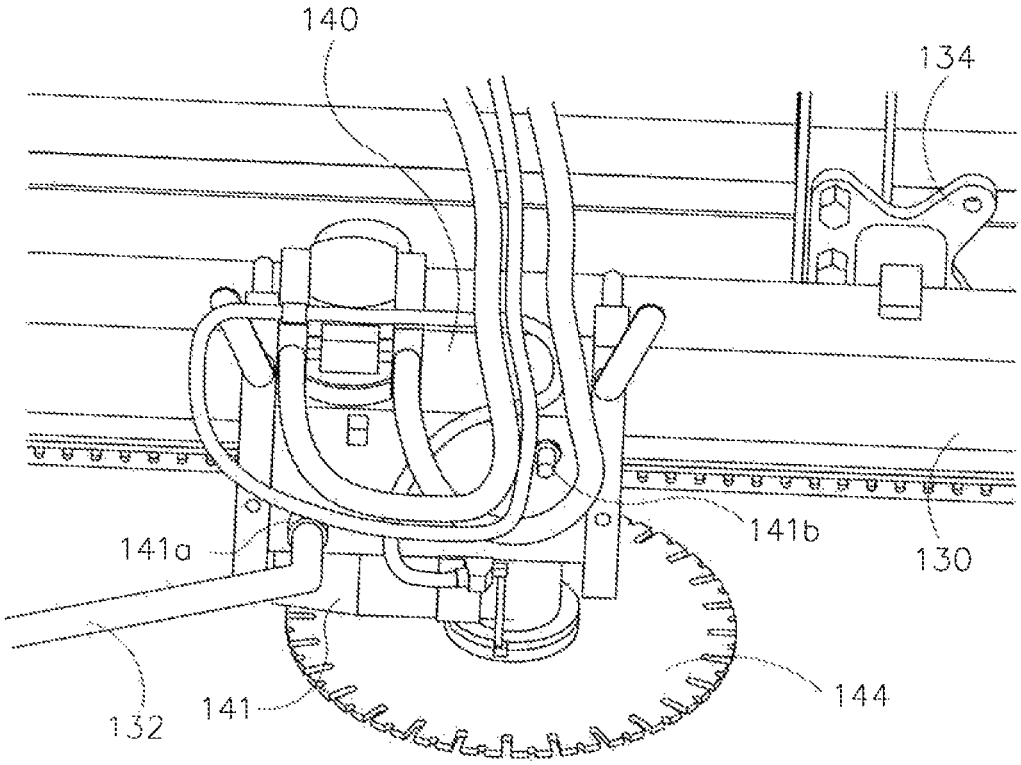
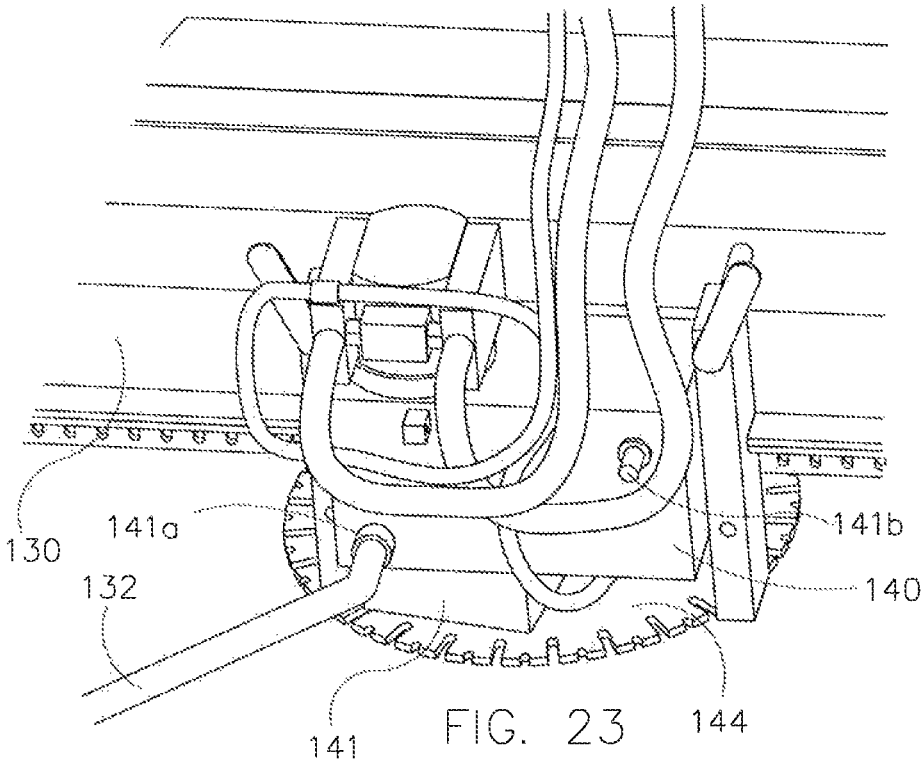
FIG. 23

SYSTEMS, MACHINES, DEVICES AND METHODS FOR EFFICIENTLY REMOVING SIDEWALK TRIP HAZARDS

This application claims priority to U.S. Provisional Application 61/301,070 filed Feb. 3, 2010, and U.S. Provisional Application 61/233,384 filed Aug. 12, 2009, each of which is incorporated herein by reference in its entirety.

BACKGROUND

1. Field of the Invention

This invention is directed to efficiently removing trip hazards from sidewalks and other non-roadway hard-surfaced paths.

2. Related Art

The Americans with Disabilities Act (ADA) requires anyone responsible for a sidewalk or other hard-surfaced pathway that is commonly used by pedestrians to eliminate trip hazards, which is the term used to describe an offset between adjacent portions of the pathway that is more than ¼ inch in height. Typically, the material used for such hard-surfaced pathways is either concrete or asphalt.

Accordingly, a significant market has developed in removing these trip hazards from sidewalks, bike paths and other hard-surfaced pedestrian pathways, and especially concrete pathways. Initially, such trip hazards were removed by replacing, for each such trip hazard, one or both of the offending portions of the hard-surfaced pathway forming that trip hazard. However, this proved too expensive and time consuming, especially if the portions of the hard-surfaced pathway were otherwise structurally sound and thus otherwise did not require replacement.

SUMMARY OF THE DISCLOSED EMBODIMENTS

One early solution to these problems, as shown in U.S. Pat. No. 5,116,162, was to grind away only the offending offset. However, this was time consuming, not significantly less expensive, and created substantial amounts of concrete dust, which is a health hazard itself. In response to these problems in grinding away the offending offset, as shown in U.S. Pat. No. 6,863,062, a further solution was to cut away the offending offset using a rotating concrete saw and blade, by plunging the blade into the top surface of the concrete slab. This solution avoided creating as much concrete dust, and the actual concrete cutting is less time consuming than grinding away the offending offset. However, moving the concrete cutting device disclosed in the 062 patent from one trip hazard location to the next and setting up that concrete cutting device at each trip hazard location was itself time consuming and complicated.

Other solutions directed to concrete cutting, such as those shown in U.S. Pat. Nos. 6,827,074; 6,896,604; 7,000,606; 7,143,760; 7,201,644 and 7,402,095, use hand-held right-angle grinders to cut off the offending offset, again by plunging the saw blade into the top surface of the concrete slab. Using hand-held right-angle grinders does not require long set-up times and allows the workers to quickly and easily move from one trip hazard location to the next. Additionally, because the blades usable with a hand-held right-angle grinder are much smaller than those used by the concrete cutting device disclosed in the 062 patent, they are less expensive.

However, these techniques are significantly more labor intensive than the concrete cutting device disclosed in the 062 patent. Furthermore, as shown in the 074 et al. patents, because hand-held right-angle grinders use much smaller blades, the typical trip hazard requires the worker(s) to make two, three or more passes with the right-angle grinder through the hard-surfaced pathway to cut away the offending offset, with the worker(s) needing to break away the cut-away portions of the hard-surfaced pathway between each pass.

Thus, the conventional solutions require either using grinding, which is time consuming, expensive, and creates substantial amounts of concrete dust, relatively-fixed machine cutting, which consumes substantial amounts of time in setting up and moving the cutting machine, or hand held cutting, which is labor-intensive (and thus expensive) and which consumes substantial amounts of time in actually cutting away the offending offset. What is needed are systems, machines, devices and systems that are able to quickly remove the offending offset, that are able to quickly and easily move from one trip hazard location to the next, that are not labor intensive, that do not create substantial amounts of concrete dust, and/or that are substantially less expensive than current solutions.

This invention provides systems, machines, devices and/or methods usable to quickly remove a trip hazard from a hard-surfaced pathway.

This invention separately provides systems, machines, devices and/or methods usable to cut away one or more offset portions of a hard-surfaced pathway with minimal set-up.

This invention separately provides systems, machines, devices and/or methods usable to cut away one or more offset portions of a hard-surfaced pathway in a single pass.

This invention separately provides systems, machines, devices and/or methods usable to cut away one or more offset portions of a hard-surfaced pathway with minimal set-up and in a single pass.

This invention separately provides systems, machines, devices and/or methods usable to cut away one or more offset portions of a hard-surfaced pathway by starting the cut in a side surface of an offset portion of the hard-surfaced pathway.

This invention separately provides systems, machines, devices and/or methods usable to control and/or capture most concrete dust created while cutting away one or more offset portions of a hard-surfaced pathway.

This invention separately provides a self-powered machine that is able to travel along a hard-surfaced pathway from one trip hazard location to the next.

In various exemplary embodiments according to this invention, a guide rail and an associated hydraulic concrete saw head and saw blade are mounted onto a small utility vehicle that can easily move the saw head and guide rails along a hard-surfaced pathway from one trip hazard to another. In various exemplary embodiments, the utility vehicle has a hydraulic power system that is sufficiently powerful that it can drive the hydraulic saw head without overheating during normal use on a typical summer day. In various exemplary embodiments, a support structure is provided between the utility vehicle and the guide rails, which are mounted to the controllable support structure.

In various exemplary embodiments, the support structure allows the utility vehicle to pick up the guide rails and saw head, easily moved them from a current location to a next location and place them so they are ready to cut off the offending offset at that next location. In various exemplary embodiments, the support structure automatically locates the guide rails and the saw head relative to a lower slab of the hard-surfaced pathway so that the location and angle of the saw blade are appropriate to create one or more appropriate transition surfaces between the offset portions of the hard-surfaced pathway.

In various exemplary embodiments, a hood is provided around the saw head and blade. In various exemplary embodiments, the hood surrounds the blade and contains the dust generated by the blade. In various exemplary embodiments, a vacuum line connects the hood to a vacuum dust collector, which draws the dust from the hood through the vacuum line. In various exemplary embodiments, the utility vehicle has a cargo bed usable to contain and carry the vacuum dust collector, a separate hydraulic pump, if used, and any desired accessories and/or spare parts.

In operation, the utility vehicle raises the support structure and moves from a current location to the location of a next trip hazard to be removed. The utility vehicle then lowers the controllable support structure so it rests on a lower slab of the hard-surfaced pathway and supports the guide rails and saw head above an upper slab of the hard-surfaced pathway. The controllable support structure, the guide rails and/or the saw head are pre-adjusted to set the saw blade to an appropriate angle, while a trip hazard engaging mechanism contacts the lower slab to automatically position the guide rail, saw head and saw blade at the appropriate angle relative to the upper slab and the trip hazard. The trip hazard engaging mechanism also contacts the vertical surface of the trip hazard to automatically locate the saw blade longitudinally relative to the edge of the trip hazard. If not already there, the saw head is moved along the guide rails to place it laterally outside of one of the lateral edges of the hard-surfaced path and adjacent to the trip hazard to be removed.

The hydraulic power system is turned on to drive the saw head and rotate the saw blade. An arm of the saw head is then rotated to move the saw blade from a disengaged position to an appropriate cutting position. The saw head and blade are then moved along the guide rails to cut into the upwardly offset portion of the hard-surfaced pathway. The cut is begun at one lateral edge of that upper portion at the full depth of the cut, i.e., the cut extends at the correct angle from the surface of the upper portion to the surface of the lower portion, such that the saw blade removes the trip hazard, in a single pass. The saw head and blade moved, either by hand or by another motor, along the guide rails to the other lateral edge of the upper portion, As a result, in one pass, the trip hazard is removed and an appropriately-sloped transition surface is created between the upper and lower portions of the hard-surfaced pathway.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein:

FIG. 1 is a side view of one exemplary embodiment of a trip hazard removing system and machine according to this invention;

FIG. 2 is a front and side perspective view of the exemplary trip hazard removing system and machine shown in FIG. 1;

FIG. 3 is a front and side perspective view showing in greater detail a first exemplary embodiment of a trip hazard removing apparatus of the exemplary trip hazard removing system and machine shown in FIG. 1;

FIG. 4 is a front and side perspective view showing the first exemplary trip hazard removing apparatus of FIG. 3 in greater detail;

FIG. 5 is a side view showing additional details of the first exemplary trip hazard removing apparatus shown in FIG. 3;

FIG. 6 is a rear and side perspective view showing additional details of the first exemplary trip hazard removing apparatus shown in FIG. 3;

FIG. 9 is a side view showing in greater detail the second exemplary embodiment of the trip hazard removing apparatus shown in FIG. 7, including an exemplary hydraulic saw head shown greater detail in FIG. 12;

FIG. 10 is a top and front perspective view showing in greater detail the second exemplary embodiment of the trip hazard removing apparatus shown in FIG. 7;

FIG. 12 is a bottom and side perspective view showing in greater detail one exemplary embodiment of a hydraulic saw head of the first exemplary trip hazard removing apparatus shown in FIG. 3;

FIG. 13 is a bottom view showing additional details of the exemplary hydraulic saw head shown in FIG. 12;

FIGS. 18 and 19 are perspective views of one exemplary embodiment of a trip hazard engaging system according to this invention;

FIGS. 20-23 are perspective views showing the saw blade according to this invention as it moves between a disengaged position and a cutting position.

DETAILED DESCRIPTION OF EXEMPLARY EMBODIMENTS

Figure 7:
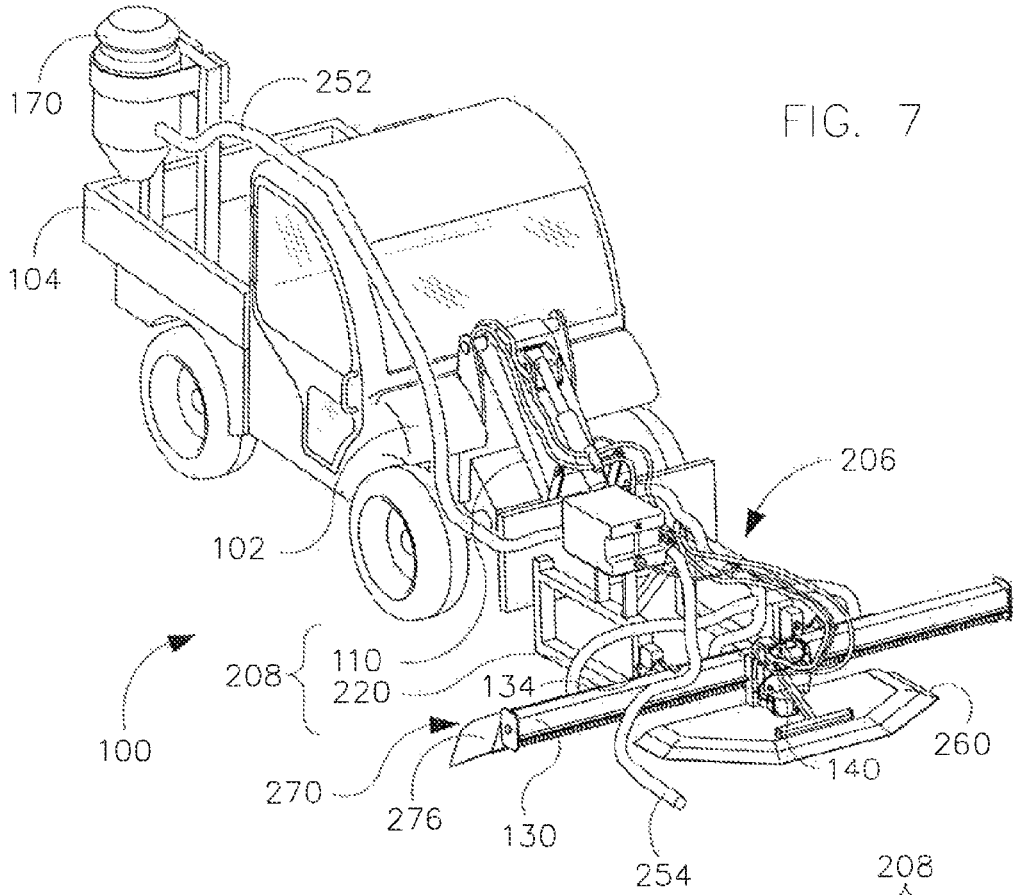
FIG. 7 is a front and side perspective view of the exemplary trip hazard removing system and machine shown in FIG. 1 including a second exemplary embodiment of a trip hazard removing apparatus.

As indicated above, this invention is directed to removing trip hazards from hard-surfaced pathways. Typically, such hard-surfaced pathways are formed from concrete, cement, asphalt, but can be formed using any known or later-developed material, or combination of materials, that is usable to create a (relatively) smooth, hard, durable, weather-resistant surface for a pathway. Typically, such pathways include sidewalks, bike paths, pedestrian walkways and/or walking paths and the like that pedestrians use to travel from one place to another, as well as any other off-road hard-surfaced structures usable by pedestrians for other purposes, such as patios, swimming pool decks, basketball and tennis courts, etc.

Trip hazards occur in hard-surfaced pathways when the positions of adjacent structurally separate portions of the hard-surfaced pathway shift relative to each other. Trip hazards can also occur in hard-surfaced pathways when a single slab or portion of the hard-surfaced pathway cracks or deforms, with or without a relative position shift of the various sub-portions on the various sides of the crack or deformation. For example, adjacent concrete slabs can shift relative to each other due to frost heaving, ground settling, root intrusions and the like. Similarly, single concrete slabs can crack into two or more portions that can then shift relative to each other for similar reasons. Improperly installed concrete slabs can also buckle due to thermal expansion, creating steep-sided upwardly thrust regions (i.e., buckles).

Likewise, paths and areas paved with asphalt can similarly crack into two or more physically distinct portions that can then shift relative to each other for similar reasons. Moreover, paths and areas paved with asphalt can become deformed due to ground settling, root intrusions, thermal expansion and the like, such that bumps, buckles, heaves and the like can form in localized areas of the asphalt-paved paths and areas. It should be appreciated that the trip hazards outlined above are illustrative only, and are not intended to be limiting.

Trip hazard removing systems, machines, apparatus and methods according to this invention are usable to remove a trip hazard in any known or later-developed hard-surfaced pathway or area, regardless of the cause. The following discussion of various exemplary embodiments of trip hazard removing systems, machines, apparatus and methods according to this invention focuses on removing trip hazards from concrete sidewalks. It should be appreciated that is also merely for ease of explanation and understanding, and is not intended to be limiting in any way.

As indicated above, conventional solutions require either using grinding, which is time consuming, expensive, and creates substantial amounts of concrete dust, relatively-fixed machine cutting, which consumes substantial amounts of time in setting up and moving the cutting machine, or hand held cutting, which is labor-intensive (and thus expensive) and which consumes substantial amounts of time in actually cutting away the offending offset.

FIG. 1 is a side view of a first exemplary embodiment of a trip hazard removing system 100 according to this invention. FIG. 2 is a front and side perspective view of the first exemplary trip hazard removing system 100 shown in FIG. 1. As shown in FIGS. 1 and 2 (and FIG. 16, which is described in greater detail below), the trip hazard removing system 100 includes a relatively small utility vehicle 102 having a cargo bed 104 and one or more hydraulically actuated front-end lift arms 110. It should be appreciated that a variety of different utility vehicles or wheeled or tracked machines that enable the saw head and guide rails to be easily moved along a sidewalk, pedestrian walkway or the like from one trip hazard to another, such as a fork lift, a skid or skid steer loader, a compact track or multi terrain loader, a loader tractor, a mini backhoe, etc., can be used as the utility vehicle 102.

Figure 16:
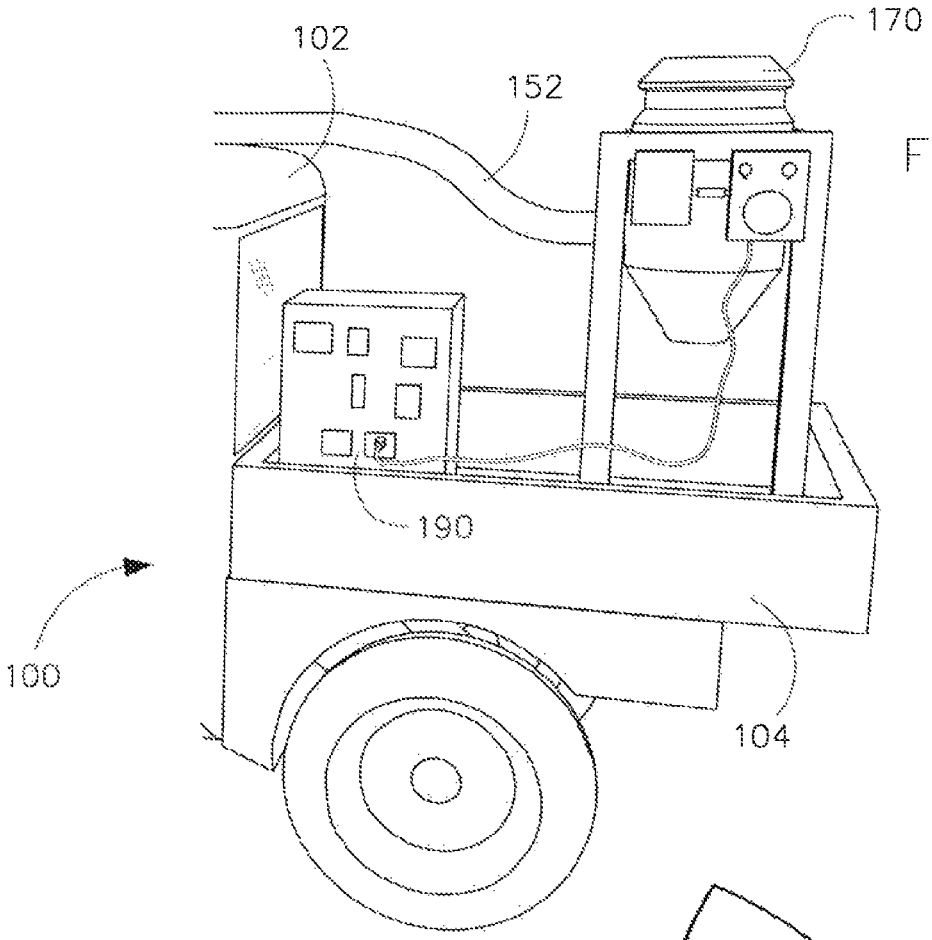
FIG. 16 is a side view of one exemplary embodiment of a cargo box, a vacuum collection device and a power supply of the trip hazard removing system and machine shown in FIG. 1.

As shown in FIG. 1, the trip hazard removing system 100 also includes a support structure 120 that is connected to the one or more hydraulically actuated front-end lift arms 110, one or more guide rails 130 that are connected to the support structure 120, a hydraulically-powered saw head 140 that is suspended from and movable along the one or more guide rails 130, a dust control apparatus 150 mounted to and movable with the saw head 140, a cooling fluid supply system 160, a vacuum dust collector 170 connected to the dust control apparatus 150 and a generator 190 usable to supply electric power for various accessories and the like that can be included in the trip hazard removing system 100 according to this invention. As shown in FIGS. 1, 2 and 16, the vacuum dust collector 170, which is connected to the dust control apparatus 150 by the vacuum tube 152, and the generator 190 are carried in the cargo bed 104 of the utility vehicle 102.

In various exemplary embodiments, the vacuum dust collector 170 is a heavy-duty construction vacuum that operates at 220 vAC. In such exemplary embodiments, the generator 190 is desirably a 10.5 kilowatt generator, which should be powerful enough to start and run the vacuum dust collector 170, as well as power various accessories, as discussed below with respect to FIG. 17, and/or various controllable electric motors, actuators or the like used to controllably adjust the orientation of the support structure 120 to the one or more hydraulically actuated front-end lift arms 110 and/or the orientation of the one or more guide rails 130 to the support structure 120, and/or to move the saw head 140 along the one or more guide rails 130

Together, the support structure 120, the one or more guide rails 130, the hydraulically-powered saw head 140, the dust control apparatus 150 and the cooling fluid supply system 160 form a first exemplary embodiment of a trip hazard removing apparatus 106 according to this invention. The support structure 120, together with the one or more hydraulically actuated front-end lift arms 110, form one exemplary embodiment of a controllable support structure 108 of the trip hazard removing system 100 according to this invention. It should be appreciated that the one or more hydraulically actuated lift arms 110 can be integrated with the utility vehicle 102, with the support structure 120 connected and disconnected from the one or more hydraulically actuated lift arms 110. Alternatively, in various other exemplary embodiments, the one or more hydraulically actuated front-end lift arms 110 are components of the first trip hazard removing apparatus 106 and are connected and disconnected from the utility vehicle 102.

In either case, the controllable support structure 108 allows the operator to controllably raise the first trip hazard removing apparatus 106 away from the concrete sidewalk so that the vehicle can move the first trip hazard removing apparatus 106 to the next trip hazard to be removed. Likewise, the controllable support structure 108 allows the operator to controllably lower the first trip hazard removing apparatus 106 into a desired or appropriate position or location adjacent to the next trip hazard to be removed and to place the first trip hazard removing apparatus 106 in a position where it remains stable while the trip hazard is being removed, i.e., stably positioning the first trip hazard removing apparatus 106 before removing the trip hazard.

It should be appreciated that the ADA limits the slope of the transition ramp between the two concrete slabs. In various exemplary embodiments, the controllable support structure 106 is usable to adjust the angle of a saw blade attached to the saw head relative to the upper concrete slab that will be cut to remove the trip hazard so that the transition surface between the adjacent concrete slabs is cut into the upper concrete slab at an appropriate slope.

It should be appreciated that the trip hazard removing system 100 needs to have a heavy-duty hydraulic power system that is powerful enough to drive the hydraulic saw head under all weather conditions. Hard-surfaced pathway materials, such as concrete, are difficult to cut through, and the trip hazard removing system 100 will typically be used to remove numerous trip hazards during a single 8-10 hour shift. Thus, under-powered hydraulic power systems can overheat quickly during use, even in moderate temperate-zone weather conditions.

In various exemplary embodiments, the utility vehicle 102 has a hydraulic power system that is sufficiently powerful that it can drive the hydraulic saw head 140 without overheating during normal use on a typical summer day. For example, the inventor has found that the vehicle 102 desirably has an auxiliary hydraulic flow rate of at least 10 gpm. The inventor has found that, with smaller systems having auxiliary hydraulic flow rates on the order of about 8.5 gpm, like those used on compact loader tractors, as the ambient air temperature rises, the hydraulic flow and power decreases, causing the saw head 140 to run very inefficiently. In various other exemplary embodiments, the trip hazard removing system 100 includes a separate hydraulic power system having sufficient power. In such exemplary embodiments, the separate hydraulic power system would be carried in the cargo bed 104 and powered by the generator 190.

FIG. 3 is a front and side perspective view showing in greater detail one exemplary embodiment of the first trip hazard removing apparatus 106. FIG. 4 is a front and side perspective view showing the exemplary first trip hazard removing apparatus 106 in yet greater detail. FIGS. 5 and 6 are a side view and a rear and side perspective view, respectively, both showing additional details of the exemplary first trip hazard removing apparatus 106.

As shown in FIGS. 3-6, in this first exemplary trip hazard removing apparatus 106, the support structure 120 includes various interconnected rigid members that are vertically or horizontally, as well as those that are transversely or longitudinally, oriented, and a dust trapper 122. In the exemplary embodiment shown in FIGS. 3-6, these rigid members are lengths of relatively thin, flat or angled iron or steel bars that have been welded and/or bolted together. One or more of the rigid members of the support structure 120 that are adjacent to and/or facing the one or more hydraulically-actuated front-end lift arms 110 are connected to the lift arm(s) 110. Similarly, one or more of the rigid members of the support structure 120 that are adjacent to and/or facing the one or more guide rails 130 are connected to the guide rail(s) 130. Additionally, the cooling fluid supply system 160 is supported by, and typically connected to, one or more of the rigid members of the support structure 120.

One or more of the rigid members of the support structure 120 are located at a bottom portion of the support structure 120 and are oriented horizontally, and transversely and/or longitudinally, to the vehicle 102. These horizontally oriented members of the support structure 120 engage the surface of a hard-surfaced slab or the like. These bottom rigid members stably support the first trip hazard removing apparatus 106 so that the trip hazard can be removed without the first trip hazard removing apparatus 106 moving relative to either the hard-surfaced slab or the like and/or to the trip hazard. Using the one or more hydraulically-actuated front-end lift arms 110, the operator can controllably place the support structure 120 on to the hard-surfaced slab or the like that forms a trip hazard to be removed and can subsequently lift the support structure 120 away from that hard-surfaced slab or the like after that trip hazard has been removed. In various exemplary embodiments, these horizontally oriented members of the support structure 120 form a trip hazard engaging mechanism 180 that engages a vertical surface of a trip hazard as well as the surface of the hard-surfaced slab or the like. This is described in greater detail below with respect to FIGS. 18 and 19.

The dust trapper 122 is connected to the bottom rigid members and extends the width of the one or more guide rails 130. A front edge of the dust trapper 122 faces the one or more guide rails 130 and the saw head 140, while a rear edge is adjacent to and/or contacts the hard-surfaced slab or the like. Accordingly, when removing a trip hazard, some of the dust generated while cutting the hard-surfaced slab or the like that is blown back towards the support structure 120 is trapped by the dust trapper 122, so that dust does not dirty the operator or the vehicle and does not foul the first trip hazard removing apparatus 106 and can be easily swept up.

As shown in FIGS. 3-6, in this exemplary embodiment, the hydraulically-powered saw head 140 is mounted on the one or more guide rails 130 and is movable laterally along the one or more guide rails 130. Various hydraulic fluid lines 142 connect the hydraulically-powered saw head 140 to the hydraulic power supply source integrated into the vehicle 102 or to a separate hydraulic power supply source located in the cargo bed 104. As shown in FIG. 4, at least one of the one or more guide rails 130 includes a rack or other device that provides some control for the position of the hydraulically-powered saw head 140 along the one or more guide rails 130.

As shown in FIG. 5, a saw blade 144 that is capable of cutting through the hard-surfaced slab or the like is mounted onto the downward facing spindle of the hydraulically-powered saw head 140. In various embodiments, and as shown in FIG. 5, the saw blade has an edge and/or teeth provided along its perimeter. For concrete, asphalt and similar materials, the saw blade 144 typically has a diamond-encrusted cutting edge and/or surface. As shown in FIGS. 3-6, the cooling fluid supply system 160 supplies a cooling fluid, such as water, through a supply tube 162 to the hydraulically-powered saw head 140. The cooling fluid flows from the supply tube 162 to the hydraulically-powered saw head 140 to cool the saw head 140. In various exemplary embodiments, the cooling fluid can also be directed onto and/or into the saw blade 144 to cool it.

That is, when temperature of the ambient air rises sufficiently, such as often occurs during the summer months, the temperature of the diamond saw blade 144 can reach a blade damaging temperature. To reduce the chance that the diamond saw blade 144 will reach the blade damaging temperature, a small drizzle of the cooling fluid is introduced into a hub of the saw head 140, and then flows into and through the center of the saw blade 144. It should be appreciated that, in various exemplary embodiments, the amount of water provided to the saw blade 144 is enough to cool the saw blade 144 but not enough to cause the concrete dust to turn into slurry. A slurry is undesirable as it can cause the vacuum line 152 and/or the vacuum dust collector 170 to plug up and become ineffective.

In the exemplary embodiments shown in FIGS. 1-26, the operator manually moves the hydraulically-powered saw head 140 along the one or more guide rails 130 using a handle 132, as shown in FIGS. 20-23. As indicated above, in this exemplary embodiment, the first trip hazard removing apparatus 106 is designed to allow the saw blade 144 to begin cutting into the hard-surfaced slab or the like from the side, rather than from the top surface of the trip hazard removing system 100 is sitting on. This allows the offset portion of the hard-surfaced slab or the like to be removed in a single pass and allows the first trip hazard removing apparatus 106 to omit structures needed to move the saw head 140 longitudinally relative to the one or more guide rails 130 so that it can be plunged into the hard-surfaced slab or the like from its top surface.

Thus, in this exemplary embodiment, as part of setting up the first trip hazard removing apparatus 106 for the next the trip hazard removing operation, the operator will use the handle 132 to move the hydraulically-powered saw head 140 to one end of the one or more guide rails 130, usually before lowering the first trip hazard removing apparatus 106 into place adjacent to that next trip hazard to be removed. Consequently, the saw blade 144 is in position adjacent to the side surface of the hard-surfaced slab or the like. Once the first trip hazard removing apparatus 106 is ready, the operator operates the hydraulic power source to supply hydraulic fluid to the saw head 140, and then begins moving the saw head 140 along the one or more guide rails 130, and thus moving the rotating saw blade 140 into the side surface of the hard-surfaced slab or the like to remove the trip hazard.

It should be appreciated that, while the first trip hazard removing apparatus 106 could use a motor and control system to move the hydraulically-powered saw head 140 along the one or more guide rails 130, doing so could significantly increase the complexity of the trip hazard removing system 100. That is, due to the typically abrasive nature of the materials used to form the hard-surfaced slab or the like, ability of the cutting edge and/or surface of the saw blade 144 to cut through the hard-surfaced slab or the like changes dramatically as the saw blade 144 is used. Consequently, the rate at which the saw blade 144 is able to move through the hard-surfaced slab or the like typically drops substantially as the saw blade 144 ages, while the temperature of the saw blade and the load on the saw head 140 can increase substantially. A usable control system would need to be capable of sensing the cutting rate, the blade temperature and the load on the saw head 140 and appropriately adjusting the motor to control the speed of the saw head 140 along the one or more guide rails 130.

FIGS. 3, 4 and 6 show one exemplary embodiment of a dust control apparatus 150 of the first trip hazard removing apparatus 106. As shown in FIGS. 1-6, the dust control apparatus 150 is provided around the hydraulically-powered saw head 140 and the saw blade 144 and is connected by a vacuum line 152 to the vacuum dust collector 170. In the exemplary embodiment shown in FIGS. 3, 4 and 6, the dust control apparatus 150 includes, in addition to the vacuum line 152, a top member 154, an outlet 156 and a skirt 158. The top member 154 extends between the saw head 140 and the saw blade 144, with the spindle of the saw head 140 extending through an opening or cut-out provided in the top member 154. In various exemplary embodiments, the top member 154 is a generally planar panel that extends a substantial amount laterally beyond the saw blade 144. A support bar 132 extends between a front face of the saw head 140 and the front region of the top member 154 to help support the top member 154 above the saw blade 144.

The skirt 158 is typically formed of a relatively soft, flexible material and typically has a length that is long enough that, for most every trip hazard, the skirt remains in contact with the hard-surfaced slab or the like. In various exemplary embodiments, the skirt 158 is attached to the side and front edges of the top member 154, although, in some exemplary embodiments, it is also attached to the rear edge of the top member 154. The outlet 156 typically extends from the top surface 154 at a side edge, at the extreme clockwise or counterclockwise spot on that side edge, depending on the rotational direction of the saw blade 144. That is, the rotating saw blade creates a flow in the space defined by the top member 154 and the skirt 158 that rotates in the same direction as the saw blade 144. The dust control apparatus 150 makes use of this flow to direct the dust, created as the saw blade 144 cuts into the hard-surfaced slab or the like, towards the outlet 156. The vacuum created by the vacuum dust collector 170 also helps draw the dust through the outlet 156 and into the vacuum line 152.

In various exemplary embodiments, the one or more controllable lift arms 110 and the support structure 120 allow the utility vehicle to pick up the guide rails 130 and the saw head 140, easily move them from a current location to a next location and place them so they are readily available to cut off the offending offset at that next location. In various exemplary embodiments, such as those outlined above, the one or more controllable lift arms 110 and the support structure 120 allows the angle of the saw blade 144 to be adjusted to the appropriate slope(s) to create one or more appropriate transition surfaces between the offset portions of the hard-surfaced slab or the like.

As outlined above, in various exemplary embodiments, the dust control apparatus 150 is provided around the saw head 140 and the saw blade 144 to contain and/or control the dust generated by the saw blade 144 as it cuts away the trip hazard. The vacuum line 152 connects the dust control apparatus 150 to the vacuum dust collector 170, which draws the dust from the hood or dust control apparatus 150 through the outlet 156 and the vacuum line 152 so that it does not spread around the local environment, into the vehicle 102 and/or the first trip hazard removing apparatus 106 and/or onto the operator.

Figure 8:
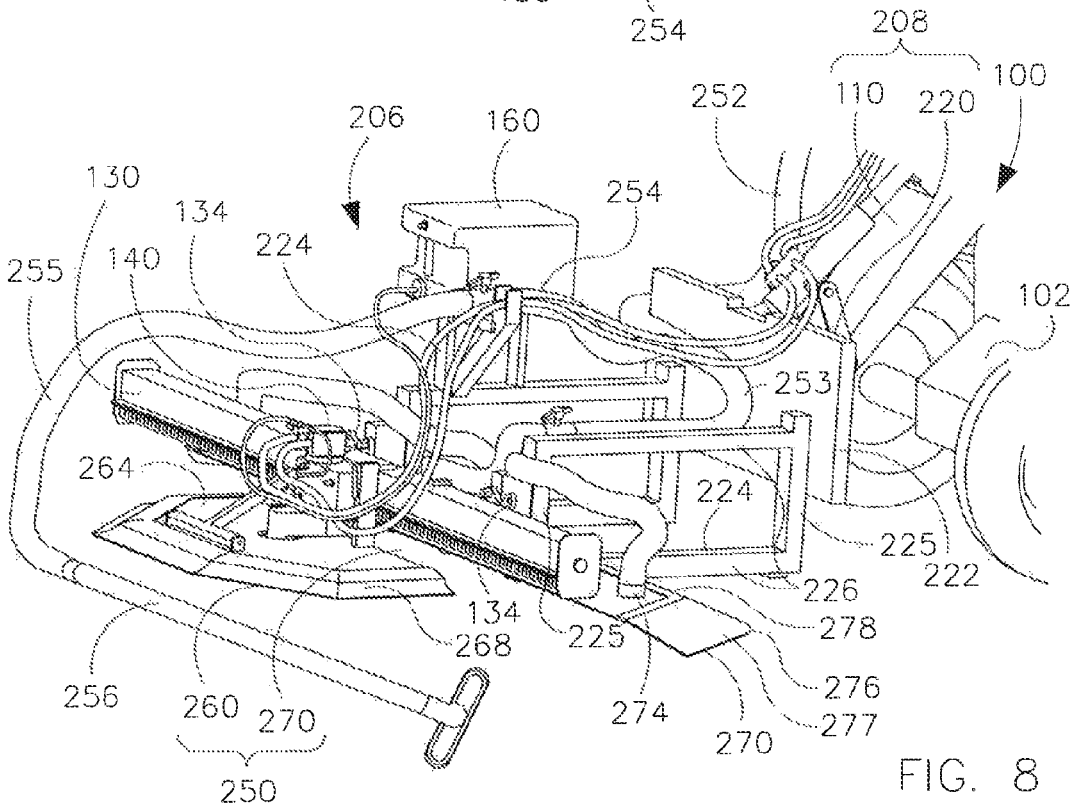
FIG. 8 is a front and side perspective view showing in greater detail the second exemplary embodiment of the trip hazard removing apparatus shown in FIG. 7.

FIG. 7 is a side perspective view of a second exemplary embodiment of the trip hazard removing system 100 shown in FIG. 1, which includes a second exemplary embodiment of a trip hazard removing apparatus 206. In particular, this second exemplary embodiment of the trip hazard removing apparatus 206 includes a second exemplary embodiment of a controllable support structure 208. FIG. 8 is a front and side perspective view showing in greater detail the second exemplary embodiment of the trip hazard removing apparatus 206 and the controllable support structure 208.

As shown in FIGS. 7 and 8, in this second exemplary embodiment of the trip hazard removing apparatus 206 and the controllable support structure 208, the trip hazard removing system 100 includes a second exemplary embodiment of a support structure 220 that is connected to the one or more hydraulically actuated front-end lift arms 110. Similarly to the first exemplary embodiment, the one or more guide rails 130 and a second exemplary embodiment of the cooling fluid supply system 160 are connected to the second exemplary support structure 220. A second exemplary embodiment of a dust control apparatus 250 includes a first portion 260 mounted to and movable with the saw head 140 and a second portion 270 mounted to the second exemplary support structure 220. The vacuum dust collector 170 is connected to the second portion 270 of the dust control apparatus 250 by a vacuum tube 252.

Together, the second exemplary support structure 220, the one or more guide rails 130, the hydraulically-powered saw head 140, the dust control apparatus 250 and the cooling fluid supply system 160 form the second exemplary embodiment of the trip hazard removing apparatus 206. The second exemplary support structure 220, together with the one or more hydraulically actuated front-end lift arms 110, form the second exemplary embodiment of the controllable support structure 208. It should be appreciated that the one or more hydraulically actuated lift arms 110 can be integrated with the utility vehicle 102, with the second exemplary support structure 220 connected to and disconnected from the one or more hydraulically actuated lift arms 110. Alternatively, in various other exemplary embodiments, the one or more hydraulically actuated front-end lift arms 110 are components of the second trip hazard removing apparatus 206 and are connected to and disconnected from the utility vehicle 102.

Similarly to the first exemplary embodiment, the controllable support structure 208 allows the operator to controllably raise the second trip hazard removing apparatus 206 away from the concrete sidewalk so that the vehicle can move the first trip hazard removing apparatus 206 to the next trip hazard to be removed. Likewise, the controllable support structure 208 allows the operator to controllably lower the first trip hazard removing apparatus 206 into a desired or appropriate position or location adjacent to the next trip hazard to be removed and stably positioning the first trip hazard removing apparatus 206 while the trip hazard is being removed.

Figure 11:
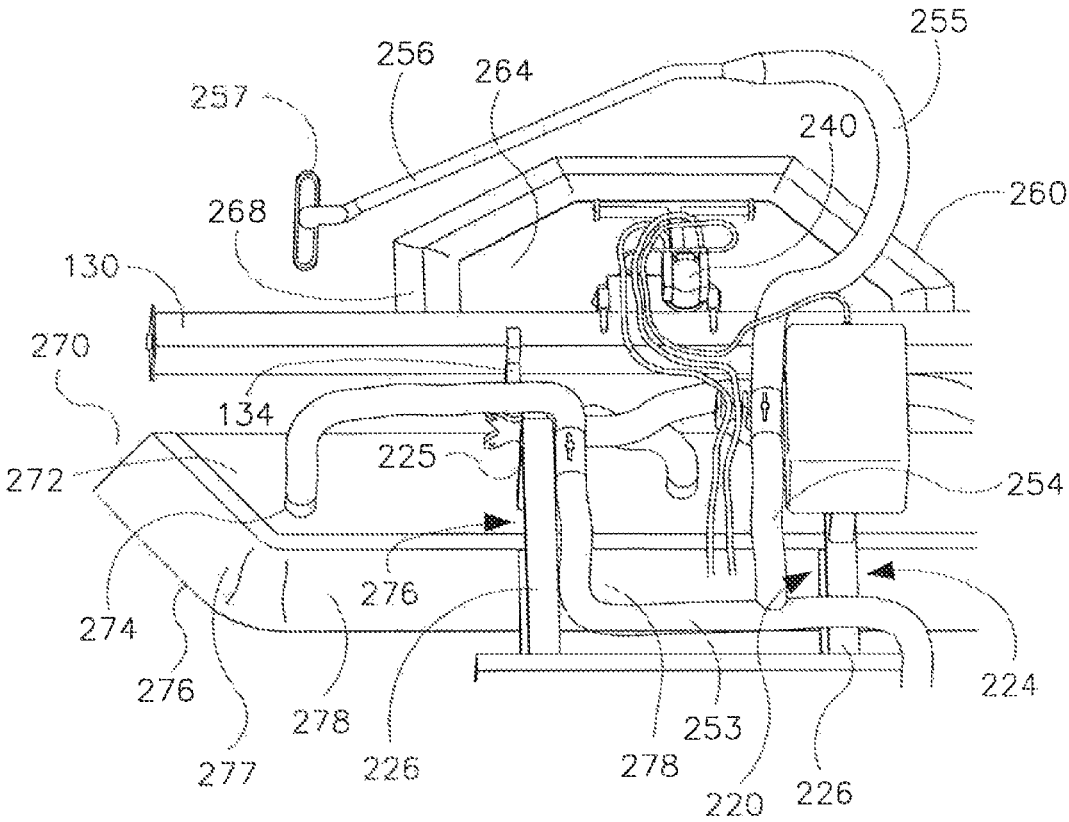
FIG. 11 is a rear and side perspective view showing additional details of the second exemplary trip hazard removing apparatus shown in FIG. 7.

FIGS. 9-11 are various views showing the second exemplary trip hazard removing apparatus 206 and second exemplary the controllable support structure 208 shown in FIGS. 7 and 8 in greater detail. FIG. 9 also shows another view of the exemplary hydraulic saw head 140 and the saw blade 144. As shown in FIGS. 7-11, in these second exemplary embodiments of the trip hazard removing apparatus 206 and the controllable support structure 208, the second exemplary support structure 220 comprises an attaching plate 222 and a number of support trusses 224. Each support truss 224 comprises a number of vertical truss members 225 and a number of horizontal truss members 226, which extend between the vertical truss members 225. In the second exemplary controllable support structure 208, a rear end of each support truss 224 is connected to a front side of the attaching plate 222, while a back side of the attaching plate 222 is attached to the one or more hydraulically actuated lift arms 110.

The bottom horizontal truss members 226 members engage the surface of a hard-surfaced slab or the like to stably support the second exemplary trip hazard removing apparatus 206 so that the trip hazard can be removed without the second exemplary trip hazard removing apparatus 206 moving relative to either the hard-surfaced slab or the like and/or to the trip hazard. Using the one or more hydraulically-actuated front-end lift arms 110, the operator can controllably place the second exemplary support structure 220 on to the hard-surfaced slab or the like that forms a trip hazard to be removed and can subsequently lift the second exemplary support structure 220 away from that hard-surfaced slab or the like after that trip hazard has been removed. This is described below in greater detail with respect to FIGS. 24-26.

In various exemplary embodiments, the one or more controllable lift arms 110 and the second exemplary support structure 220 allow the utility vehicle to pick up the guide rails 130 and the saw head 140, easily move them from a current location to a next location and place the guide rails 130 and the saw head 140 so they are readily available to cut off the offending offset at that next location. In various exemplary embodiments, the one or more controllable lift arms 110 and the second exemplary support structure 120 allows the angle of the saw blade 144 to be adjusted to the appropriate slope(s) to create one or more appropriate transition surfaces between the offset portions of the hard-surfaced slab or the like.

In this second exemplary trip hazard removing apparatus 206, a front end of each support truss 224 is connected to the one or more guide rails 130. The one or more guide rails 130 are connected to the front vertical truss members 225, while the cooling fluid supply system 160 is mounted on at least one of the top horizontal truss members 226. The second portion 270 of the second exemplary dust control apparatus 250 is attached to the bottom horizontal truss members 226 and extends around the front vertical truss members 225.

The vacuum tube 252 extends from the vacuum dust collector 170 and branches into a dust collector portion 253 and a sweeper portion 254. In this second exemplary trip hazard removing apparatus 206, the portions 253 and 254 of the vacuum tube 252 are attached to and supported by the support trusses 224 and/or the attaching plate 222. The dust collector portion 253 is connected to the second portion 270 of the second exemplary dust control apparatus 250. The sweeper portion 254 includes a flexible vacuum tube portion 255, a rigid hand-holdable vacuum tube portion 256 and a sweeper head 257. A free end of the flexible vacuum tube portion 255 is connected to a first end of the rigid hand-holdable vacuum tube portion 256, while the sweeper head 257 is connected to the second end of the rigid hand-holdable vacuum tube 256. The vacuum tube 252 also includes valves for the hand vacuum line and for the carriage hood line. These valves are selectively opened and closed to controllably connect the dust collector portion 253 and the sweeper portion 254 to the vacuum dust collector 170.

Similarly to the dust control apparatus 150, the first portion 260 of the second exemplary dust control apparatus 250 includes a top member 264 and a skirt 268, but can optionally omit an outlet similar to the outlet 156. The top member 264 extends between the saw head 140 and the saw blade 144, with the spindle of the saw head 140 extending through an opening or cut-out provided in the top member 264. In various exemplary embodiments, the top member 264 is a generally planar panel that extends a substantial amount laterally beyond the saw blade 144.

The skirt 268 is typically formed of a relatively soft, flexible material and typically has a length that is long enough that, for most every trip hazard, the skirt remains in contact with the hard-surfaced slab or the like. In various exemplary embodiments, the skirt 268 is attached to the side and front edges of the top member 264. In some exemplary embodiments, such as those that include an outlet similar to the outlet 156, the skirt 268 can also be attached to the rear edge of the top member 264. In such embodiments, the outlet would be connected to the dust collector portion 253 of the vacuum line 252.

The second portion 270 of the second exemplary dust control apparatus 250 includes a top member 272, one or more outlets 274 and a flexible skirt 276 that is similar to the dust trapper 122. The second portion 270 of the second exemplary dust control apparatus 250 extends the width of the one or more guide rails 130. The top member 272 is generally parallel to the top member 264 and is located even with or vertically above the top member 264. A front edge of the top member 272 faces the one or more guide rails 130 and the saw head 140. The outlets 274 extend from the top member 272, while side portions 277 of the skirt 276 are attached to the side edges of the top member 272 and a rear portion 278 of the skirt 276 is attached to a rear edge of the top member 272. The side and rear portions 277 and 278 extend from the top member 272 toward and contact the hard-surfaced pathway. Typically, they are sufficiently long that they extend along and drag against the hard-surfaced pathway.

If only one outlet 274 is used, that outlet 274 typically extends from the extreme left or right side of the top member 272, depending on the rotational direction of the saw blade 144. That is, in the space defined by the top members 264 and 272 and the skirts 268 and 276, the rotating saw blade 144 creates a flow that rotates in the same direction as the saw blade 144. The dust control apparatus 250 makes use of this flow to direct the dust, created as the saw blade 144 cuts into the hard-surfaced slab or the like, towards the single outlet 274. The vacuum created by the vacuum dust collector 170 also helps draw the dust through the outlet 274 and into the dust collector portion 253. If two or more outlets 274 are implemented, they are typically distributed along the width of the top member 272. For any dust that escapes the dust control apparatus 250, the sweeper head 257 is easily maneuverable by the operator holding the rigid hand-holdable vacuum tube portion 256 to sweep up at least some of that dust.

It should be appreciated that, in various exemplary embodiments, the first and/or second support structure 120 and/or 220 has a universal hookup for skid or skid steer loaders, loader tractors, mini backhoes and the like. In various other exemplary embodiments, the first and/or second support structure 120 and/or 220 is pivotably and/or rotationally connected to the one or more hydraulically-actuated front-end lift arms 110. In such exemplary embodiments, as the first and/or second support structure 120 and/or 220 is placed onto and engages the hard-surfaced slab or the like, the support structure 120 and/or 220 pivots or rotates relative to the one or more hydraulically-actuated front-end lift arms 110.

As a result, the first and/or second support structure 120 and/or 220 sits flat against the surface of the hard-surfaced slab or the like, with the one or more guide rails 130 and the hydraulically-powered saw head 140 being oriented generally parallel to the transverse direction and/or the longitudinal direction of the surface of the hard-surfaced slab or the like. It should be appreciated that the first and/or second support structure 120 and/or 220 can pivot transversely to the one or more hydraulically-actuated front-end lift anus 110, longitudinally to the one or more hydraulically-actuated front-end lift arms 110, or both. This will depend on how the first and/or second support structure 120 and/or 220 is pivotably and/or rotatably connected to the one or more hydraulically-actuated front-end lift arms 110.

It should also be appreciated that, in various other exemplary embodiments, the first and/or second support structure 120 and/or 220 is connected to the one or more hydraulically-actuated front-end lift arms 110 at a generally fixed orientation. In some such exemplary embodiments, the operator can adjust the generally fixed orientation of the first and/or second support structure 120 and/or 220 relative to the one or more hydraulically-actuated front-end lift arms 110. In some such exemplary embodiments, the first and/or second support structure 120 and/or 220 is connected to, a hydraulically adjustable element of the one or more hydraulically-actuated front-end lift arms 110 that the operator can adjust the orientation of the first and/or second support structure 120 and/or 220 using the vehicle's lift arm control system. In other such exemplary embodiments, the first and/or second support structure 120 and/or 220 is connected to a manually adjustable element of the front-end lift arms 110, such that the operator adjusts the orientation of the first and/or second support structure 120 and/or 220 by hand.

As indicated above, the one or more guide rails 130 are connected to and supported by the first and/or second support structures 120 and/or 220. It should be appreciated that, in various exemplary embodiments, the one or more guide rails 130 are pivotably and/or rotatably connected to the first and/or second support structure 120 and/or 220. In some such exemplary embodiments, after the first and/or second support structure 120 and/or 220 is placed onto and engages the hard-surfaced slab or the like, the one or more guide rails 130 can be adjusted, by pivoting and/or rotating it relative to the first and/or second support structure 120 and/or 220 so that the one or more guide rails 130 extend in a plane that is parallel to the surface of the hard-surfaced slab or the like that will be cut to remove the trip hazard. This is further discussed below with respect to FIGS. 18 and 19.

In various exemplary embodiments, such as that shown in FIG. 9, a number of mounting devices 134 are provided between the support structure 220 and the one or more guide rails 130 (and thus between the support structure 220 and the saw head 140). The mounting devices 134 allow the angle of guide rails, and thus the angle of the saw head 140 and the saw blade 144, relative to the support structure 220 to be adjusted (based on the appropriate slope(s)) to create one or more appropriate transition surfaces between the offset portions of the hard-surfaced slab or the like. In various other exemplary embodiments, the saw head 140 is mounted to the one or more guide rails 130 using adjustable brackets that allow the saw head 140, and thus the saw blade 144, to be adjusted to any angle along the horizontal plane of the cut.

In other such exemplary embodiments, if one of the hard-surfaced slabs or the like on one side of the trip hazard is skewed relative to the other hard-surfaced slab or the like, the one or more guide rails 130 can be adjusted, by pivoting and/or rotating it relative to the first and/or second support structure 120 and/or 220 using the mounting devices 134 so that the one or more guide rails 130 extend in a plane that is parallel to the surface of the hard-surfaced slab or the like that will not be cut. Typically, mounting devices 134 for the one or more guide rails 130 are manually adjustable relative to the first and/or second support structure 120 and/or 220, although any type of adjustable connection could be used.

Figure 14:
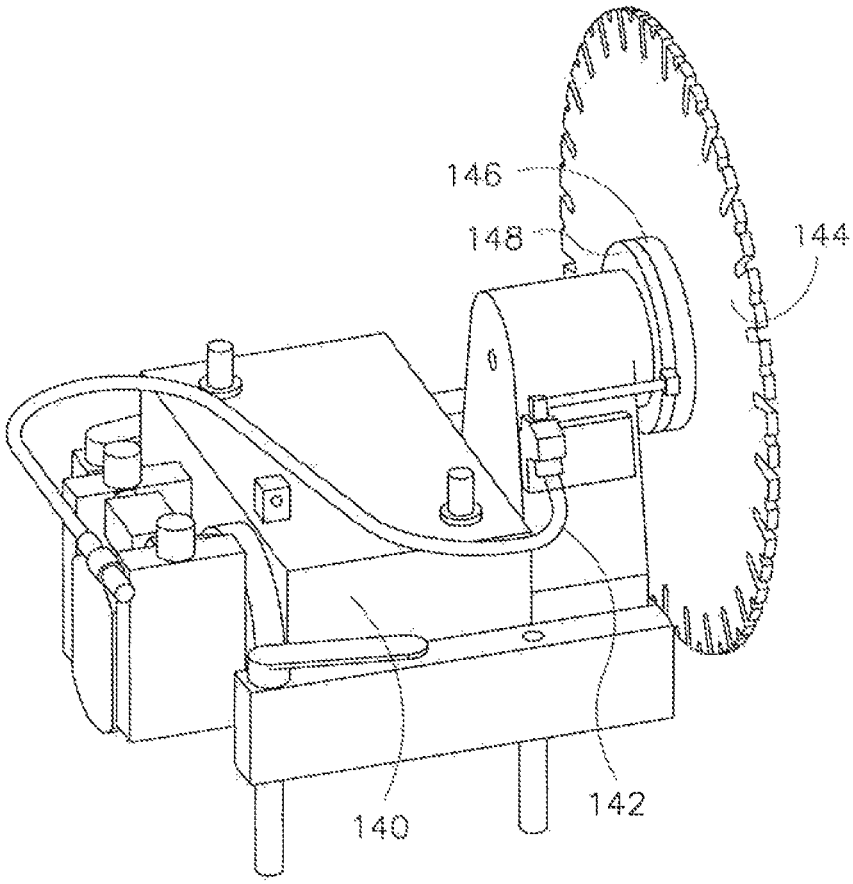
FIG. 14 is a front and side perspective view showing additional details of the exemplary saw head shown in FIG. 12 and one exemplary embodiment of a saw blade according to this invention.
Figure 15:
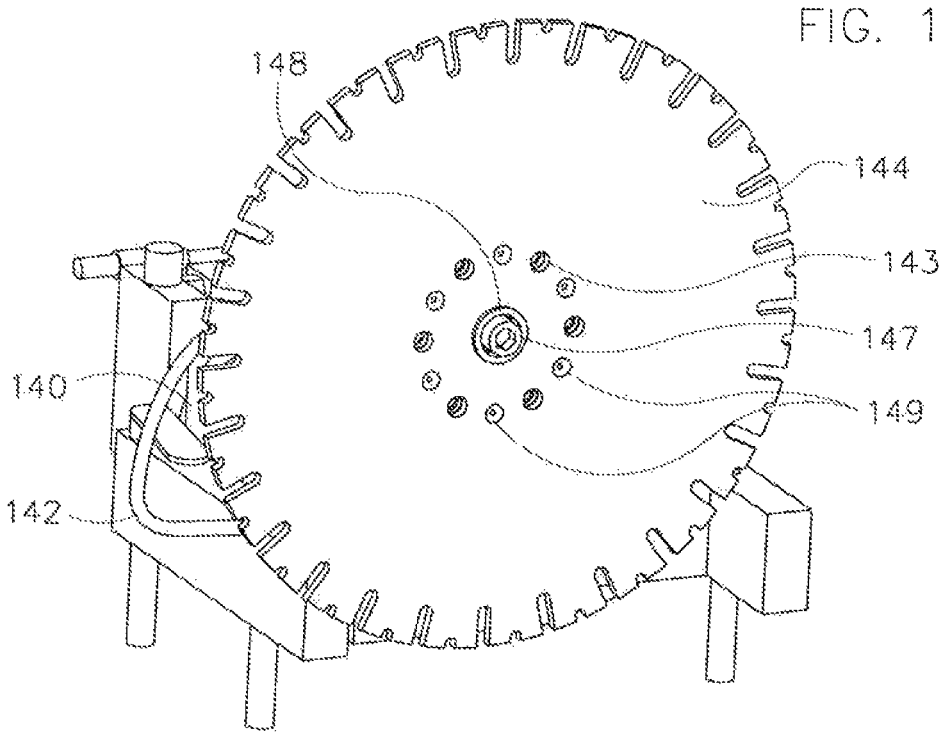
FIG. 15 is a bottom view showing additional details of the exemplary hydraulic saw head shown in FIG. 12 and the saw blade shown in FIG. 14.

FIGS. 12 and 13 are a bottom and side perspective view, and a bottom view, respectively, showing additional details of the hydraulic saw head 140. FIGS. 14 and 15 are a front and side perspective view and a bottom view, respectively, showing additional details of the saw head 140 after the saw blade 144 is attached to the saw head 140. As shown in FIGS. 12 and 13, the saw head 140 has a spindle 145 and an associated back plate 148. In this exemplary embodiment, a conventional flush-cut mounting hub 146 is attached to the spindle 145 and the backplate 148 by a bolt 147 that passes through a central aperture in the conventional flush-cut mounting hub 146 and screws into a threaded aperture in the spindle 145. As shown in FIG. 12, when the conventional flush-cut mounting hub 146 is mounted onto the spindle 145 and the backplate 148, the axially outer surface of the bolt 147 is flush with a raised central rim of the conventional flush-cut mounting hub 146.

As shown in FIGS. 14 and 15, when the saw blade 144 is mounted to the conventional flush-cut mounting hub 146, the raised central rim and the bolt 147 extend through a central aperture in the saw blade 144, with the axially outer surfaces of the raised central rim and the bolt 147 flush with the corresponding surface of the saw blade 144. To connect the saw blade 144 to the conventional flush-cut mounting hub 146, a number of cap-head bolts 149 are inserted through corresponding ones of a ring of apertures 143 in the saw blade and screwed into corresponding threaded apertures in the conventional flush-cut mounting hub 146 shown in FIG. 13. Again, the axially outer surfaces of the cap-head bolts 143 are flush with the corresponding surface of the saw blade 144. Consequently, the outer surface of the saw blade 144 does not have any projecting elements that would prevent it from being flush against a surface of the hard-surfaced slab or the like.

FIG. 16 is a side view of one exemplary embodiment of the cargo bed 104, the vacuum dust collector 170 and the power supply or generator 190 of the trip hazard removing system 100. As outlined above, the cargo bed 104 holds these additional devices of the trip hazard removing system 100, as well as spare parts and other devices of the trip hazard removing system 100 as the vehicle 102 moves from trip hazard to trip hazard. The power supply 190 supplies electric power to any electrically-powered hand tools that might be necessary or desirable to use when using the trip hazard removing system 100.

Figure 17:
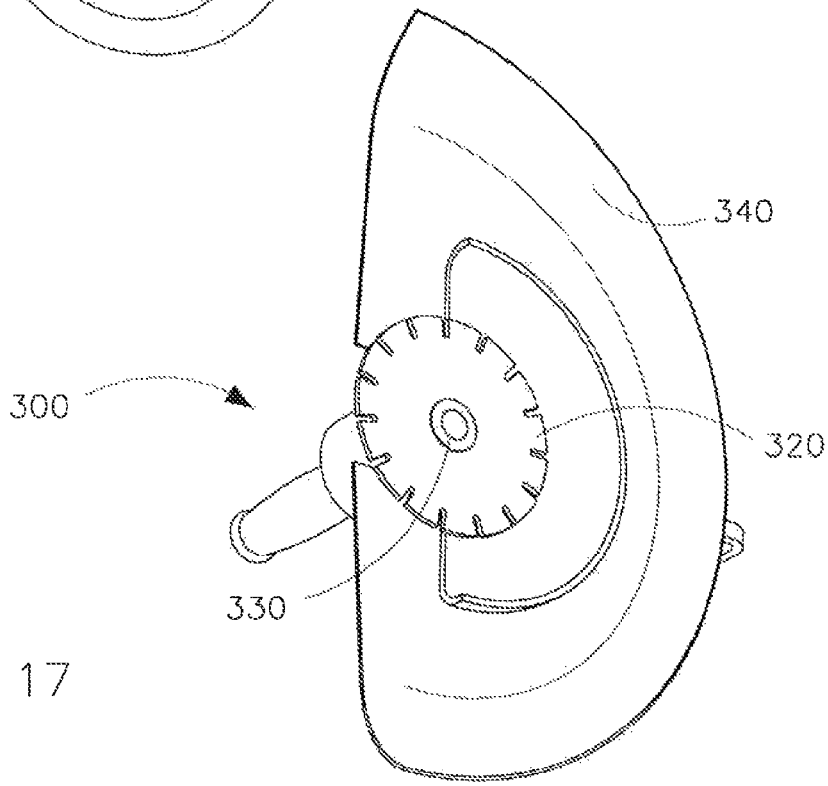
FIG. 17 is a bottom and front perspective view of one exemplary embodiment of a hand-held trip hazard trimming saw of the trip hazard removing system according to this invention.

For example, FIG. 17 is a bottom and front perspective view of one exemplary embodiment of a hand-held trip hazard trimming saw 300 of the trip hazard removing system 100 according to this invention. In some instances, the first and/or second trip hazard removing apparatus 106 and/or 206 cannot be used to fully remove the trip hazard. In particular, the hand-held trip hazard trimming saw 300 is used for spots where the saw head 140 and/or the saw blade 144 cannot travel through the entire trip hazard to be removed. This typically occurs where one edge of the trip hazard is adjacent to a fence, a rock or other kind of wall, a building, a tree, shrub, bush or other plant and/or other interfering object or structure. That is, in the usual situation, the saw blade 144 is positioned along the one or more guide rails 130 so that it is outside of one lateral edge of the hard-surfaced slab or the like. To completely remove the trip hazard, the saw blade cuts through the hard-surfaced slab or the like and extends through and past the other lateral edge of the hard-surfaced slab or the like.

However, when such adjacent objects or structures are present, those adjacent objects or structures can prevent the operator from positioning one or more guide rails 130 relative to the trip hazard such that the saw blade 144 is able to cut completely through the trip hazard. Additionally, even if the one or more guide rails 130 could be positioned so that the saw blade 144 would be able to cut completely through the trip hazard, that might require the saw blade 144 to cut into that adjacent object or structure. However, the operator may not be allowed to cut into that adjacent object or structure, for aesthetic or structural reasons.

Thus, in such situations, after the saw blade 144 is used to remove as much of the trip hazard as possible, any remaining portions of the trip hazard are cut away using the hand-held trip hazard trimming saw 300. In the exemplary embodiment shown in FIG. 17, the hand-held trip hazard trimming saw 300 includes an angle grinder 310, a small saw blade 320, a non-flush-mount mounting nut 330 and a dust shield 340. In various exemplary embodiments, the hand-held trip hazard trimming saw 300 is a 9-inch angle grinder with an attached 7-inch diamond blade. Because the hand-held trip hazard trimming saw 300 is used only after the saw head 140 has removed a substantial majority of the trip hazard, is not necessary to flush mount the small saw blade 320 to the right-angle grinder 310. The hand-held trip hazard trimming saw 300 can also be used to remove any burrs or the like, and/or trim or smooth rough or uneven edges of the hard-surfaced slab or the like.

FIGS. 18 and 19 are perspective views of one exemplary embodiment of a trip hazard engaging mechanism 180 according to this invention. As indicated above, the trip hazard engaging mechanism 180 engages a vertical surface of a trip hazard and the surface of the lower hard-surfaced slab or the like. In particular, FIGS. 18 and 19 show the trip hazard engaging mechanism 180 in combination with the second exemplary embodiment of a trip hazard removing apparatus 206 and especially the second exemplary embodiments of the support structure 220, as well as the second portion 270 of the exemplary embodiment of the dust control apparatus 250 and the cooling fluid supply system 160.

FIGS. 18 and 19 show in greater detail the undersides of the top member 272 and the flexible skirt 276 of the second portion 270 of the second exemplary dust control apparatus 250. The openings of certain of the outlets 274 are also visible in FIGS. 18 and 19. FIGS. 18 and 19 also illustrate in greater detail one exemplary embodiment of the mounting devices 134 that pivotably and/or rotationally connect the guide rail(s) 130 to either of the first or second support structure 120 or 220.

As shown in FIGS. 7-9, the lower horizontally oriented truss members 226 extend under the skirt 276. Similarly, as shown in FIG. 6, lower horizontal members of the first exemplary support structure 120 extend under the skirt 122. The front portions of these lower horizontal members of the first and second exemplary support structures 120 and 220 form one exemplary embodiment of a trip hazard engaging mechanism 180 according to this invention.

Specifically referring to the second exemplary embodiment of the trip hazard removing apparatus 206 shown in FIGS. 18 and 19, the end portions of the lower horizontally oriented truss members 226 of the second exemplary support structure 220 form the illustrated exemplary embodiment of the trip hazard engaging mechanism 180. As shown in FIGS. 18 and 19, the trip hazard engaging mechanism 180 includes a horizontal support member 182 and a resilient support pad 184 having a front surface 186 and a bottom surface 188. The front surface 186 of the resilient support pad 184 forms an engaging surface of the trip hazard engaging mechanism 180. That is, the front or trip hazard engaging surface 186 engages a vertical surface of a trip hazard, while the bottom surface 188 rests on the lower slab. The thickness of the resilient support pad 184 from the horizontal support member 182 and the location of the resilient support pad 184 on the horizontal support member 182 define the position the support structure 220, and thus the position of the saw blade 144, relative to the trip hazard to be removed.

In various exemplary embodiments, the relative location of the front or trip hazard engaging surface 186 to the fully engaged position of the saw blade 144 is selected so that, when the front or trip hazard engaging surface 186 engages the vertical surface of the trip hazard that is being removed, the rearmost edge of the saw blade 144 will just cut through that trip hazard's vertical surface. Similarly, in various exemplary embodiments, the thickness of the resilient support pad 184 is selected so that, when the resilient support pad 184 rests against the lower slab and the front or trip hazard engaging surface 186 engages the vertical surface of the trip hazard that is being removed, the vertical position of the cut formed by the saw blade 144 at the trip hazard's vertical surface is substantially co-planar with the upper surface of the lower slab that the trip hazard engaging mechanism 180 rests upon.

FIGS. 20-23 are perspective views showing the saw blade 144 according to this invention as it moves between a disengaged position and a cutting position. In particular, FIG. 20 shows the saw blade 144 in a fully disengaged position where the saw blade 144 does not intersect the upper slab of a sidewalk 151 having a trip hazard 153 to be removed. FIGS. 21 and 22 show two interim positions where the saw blade 144 is able to engage the upper slab but is not completely into the cutting position. FIG. 23 shows the saw blade 144 completely in the cutting position.

As shown in FIGS. 20-23, the saw head 140 includes a rotatable arm 141, with the spindle 145 located at the far or free end of the arm 141. The arm 141 contains a gear train that conveys rotational energy from the hydraulic motor to the spindle 145. A manually rotatable spindle **141*a* is usable to rotate the arm 141 between the disengaged and cutting positions. As shown in FIGS. 20-23, a handle 132 can be fit onto the spindle 141*a* and rotated to rotate the spindle 141*a*. The same handle 132 can be fit onto a second manually rotatable spindle 141***b* and rotated to move the saw head 140 along the guide rail 130.

It should be appreciated that, while the vehicle 102 and the trip hazard removing system 100 rest on the lower slab, the saw head 140 and the saw blade 144 extend over the upper slab. The saw head 140 and the saw blade 144 are thus tilted so that the forwardmost areas or portions of the saw head 140 and the saw blade 144 are farther away from the upper and lower slabs than the rearmost areas or portions of the saw head 140 and the saw blade 144. The saw blade 144 thus forms an angle with the upper surface of the upper slab that faces away from the lower slab and defines a plane that passes through the upper slab to intersect with the lower slab.

Consequently, when the saw blade 144 is moved rearwardly toward the saw head 140 from the disengaged position shown in FIG. 20 to the full cutting position shown in FIG. 23, and then moved along the guide rail(s) 130, the saw blade 144 will cut off the trip hazard and create a cut surface that slopes from the upper surfaces of the upper slab to the upper surface of the lower slab. In particular, to comply with the ADA regulations, the saw head 140 and the saw blade 144 are tilted so that the angle between the saw blade 144 and the upper surface of the lower slab is no greater than 7.125° (i.e., $\tan^{-1}(1/8)$).

Figure 24:
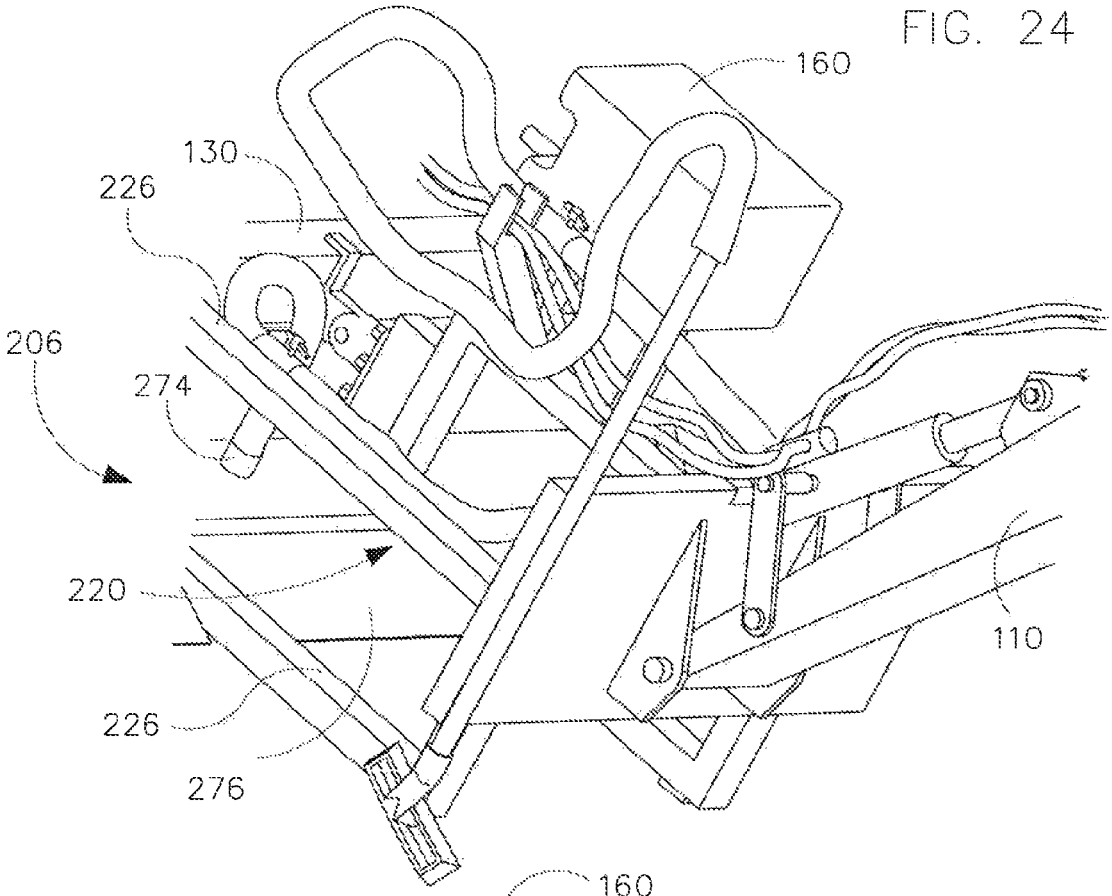
FIGS. 24-26 are perspective view illustrating the second exemplary trip hazard removing apparatus according to this invention as it is moved between a disengaged position and a cutting position.
Figure 25:
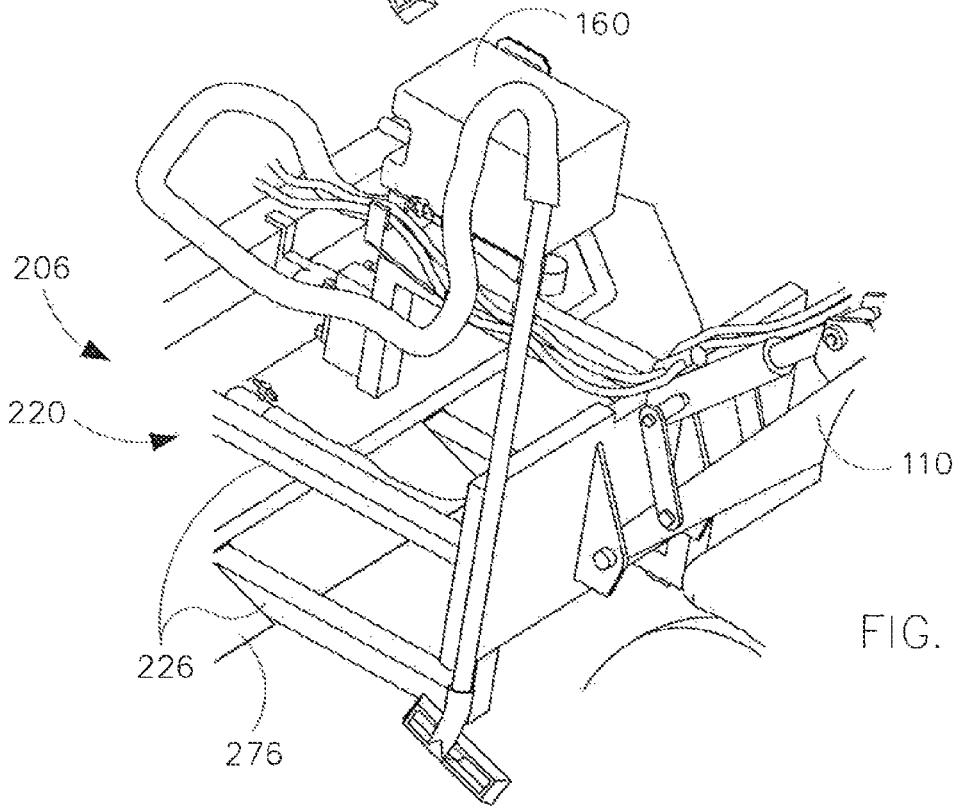
Figure 26:
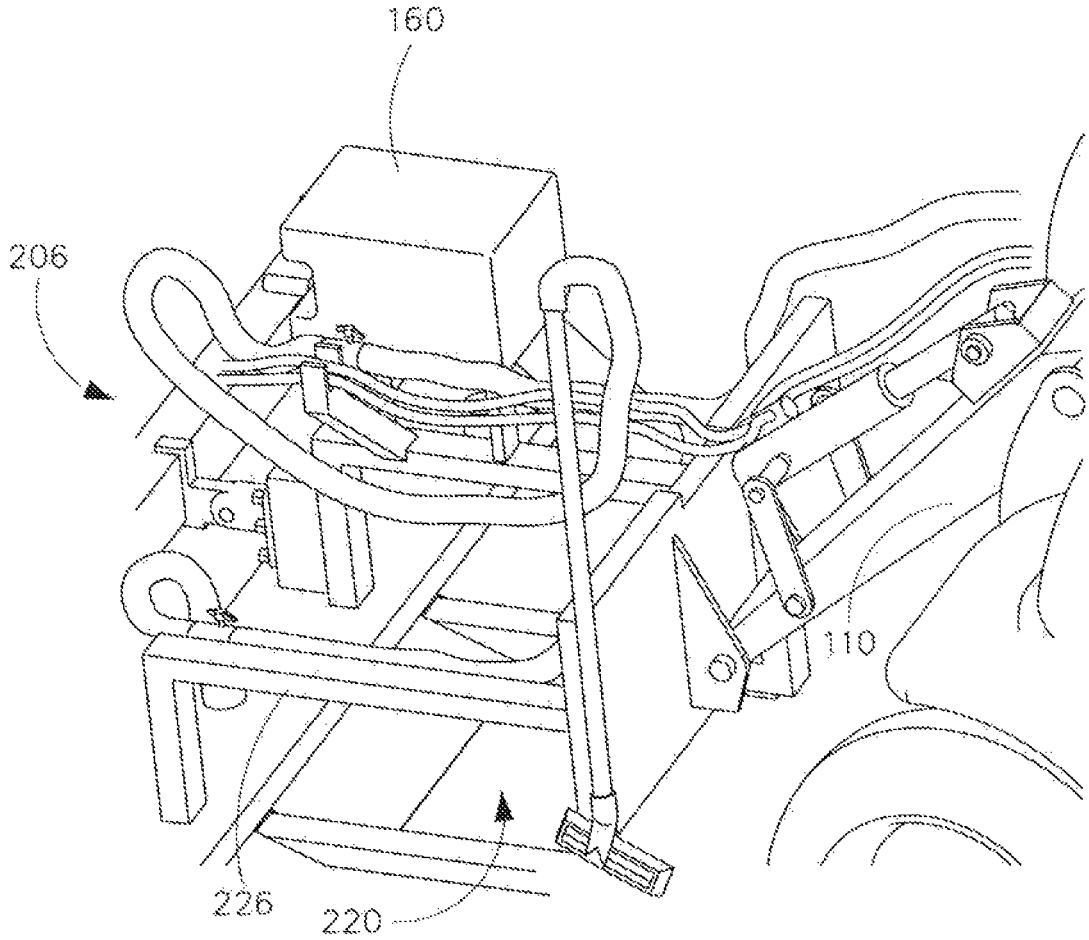

FIGS. 24-26 are perspective views illustrating the second exemplary trip hazard removing apparatus 206 according to this invention as it is moved between a disengaged position and a cutting position. In particular, FIG. 24 shows the vehicle 102 with the front-end lift arms 110, and thus the second exemplary trip hazard removing apparatus 206, in a disengaged position where the second exemplary trip hazard removing apparatus 206 is located away from a sidewalk, plaza, or the like that has a trip hazard to be removed. FIG. 25 shows the vehicle 102 with the front-end lift arms 110, and thus the second exemplary trip hazard removing apparatus 206, in an intermediate position as the second exemplary trip hazard removing apparatus 206 is being moved from the disengaged position to the cutting position, or vise-versa.

FIG. 26 shows the vehicle 102 with the front-end lift arms 110, and thus the second exemplary trip hazard removing apparatus 206, in a cutting position where the second exemplary trip hazard removing apparatus 206 rests upon a sidewalk, plaza, or the like that has a trip hazard to be removed. In particular, as discussed above, the trip hazard engaging mechanism 180 rests on a lower slab of the sidewalk, plaza, or the like that has a trip hazard to be removed and is positioned so that the front surface 186 of the resilient member 182 of the trip hazard engaging mechanism 180 contacts the vertical surface of the trip hazard.

In various exemplary modes of operation, to cut away a trip hazard according to this invention, the operator first drives the vehicle 102 so that the trip hazard removing apparatus 106 or 206 is proximate to the trip hazard to be removed. The operator then positions the support structure 120 or 220 so that it lies flat on the hard-surfaced pathway or the like. In particular, the support structure 120 or 220 is placed tight against the upper or raised portion of the hard-surfaced pathway or the like that will be cut to remove the trip hazard. Once the bottom members or feet of the support structure 120 or 220 have been positioned flat and tight against the upper or raised portion of the hard-surfaced pathway or the like to be cut at the appropriate location, the operator can begin supplying the hydraulic fluid to the saw head 140 through the hydraulic lines 142.

As indicated above, the vehicle 102, and the first or second exemplary support structure 120 or 220 via the trip hazard engaging mechanism 180, rest on the lower slab. Likewise, in some exemplary embodiments, the first or second exemplary support structure 120 or 220 is rotatably and/or pivotably connected to the front-end lift arms 110. As a result, when the first or second exemplary support structure 120 or 220 is lowered to the lower slab, the first or second exemplary support structure 120 or 220 rests on the lower slab so that the guide rail(s) 130 are parallel to the upper surface of the lower slab. That is, by placing the vehicle 102 on the lower slab, the guide rail(s) 130 are parallel to the upper surface of the lower slab, at least to a first approximation. If the lower slab is broken, twisted, etc., the attaching plate 222 or the like allows the first or second exemplary support structure 120 or 220 to rotate and/or pivot relative to the front-end lift arms 110.

Thus, if a front portion of the lower slab is pitched, tilted, rotated or the like to the back portion that the vehicle 102 rests on, when the trip hazard engaging mechanism 180 engages the front portion of the lower slab and the vertical surface of the trip hazard, the first or second exemplary support structure 120 or 220 rotates and/or pivots so that the guide rail(s) 130 are parallel to that front portion. As a result, when the trip hazard is cut off, the cut surface smoothly connects the upper surfaces of the upper and lower surfaces, across the width of the slabs, regardless of the relative orientations of the upper and lower slabs, without having to make any specific adjustments to the orientation of the guide rail(s) 130 to the first or second exemplary support structure 120 or 220 and/or the orientation of the saw head 140 to the guide rail(s) 130.

In various exemplary embodiments, as discussed above, because the guide rail extends laterally beyond the edges of at least the upper slab, the saw blade 144 can be placed into the cutting position while outside the lateral edges of the upper slab. This allows the saw blade 144 to begin cutting into the lateral vertical edge of the upper slab, rather than cutting first into the upper surface of the upper slab. In contrast, if the guide rail does not extend that far, if there is insufficient room for the saw blade or for any other appropriate reason, the saw blade 144 can begin to cut into the upper surface of the upper slab as the saw blade 144 is moved between the disengaged and full cutting positions.

That is, if the saw head 140 is not already there, it is moved along the one or more guide rails 130 so that it is positioned to the right side of the one or more guide rails 130 as the operator stands in front of the trip hazard removing apparatus 106 or 206 and the vehicle 102. The vacuum dust collector 170 is turned on and the cooling fluid is supplied from the cooling fluid supply system 160. The arm 141 is then rotated downwardly toward the support structure 120 or 220 so that the saw blade 144 is at the appropriate cutting position relative to the trip hazard to be removed and is to the right of and adjacent to the right side of the hard-surfaced pathway or the like. The saw head 140 and the saw blade 144 are then moved along the one or more guide rails 130 and across the hard-surfaced pathway or the like.

Once the saw blade 144 has cut through and passed beyond the left side of the hard-surfaced pathway or the like, the arm 141 is then rotated away from the support structure 120 or 220 and the upper and lower slabs. If another pass is required, the saw head 140 is returned to the right side of the upper slab, the portion of the trip hazard overhanging the cut is then broken away, if it hasn't spontaneously broken away, and the arm 141 is rotated into the full cutting position. The saw head 140 and the saw blade 144 are then moved along the one or more guide rail(s) 130 and across the hard-surfaced pathway or the like to complete the cut, such that the trip hazard is completely severed from the upper slab. In contrast, if the trip hazard is completely severed from the upper slab, the hazard removing apparatus 106 or 206 can then be moved to the next trip hazard to be removed without running the saw blade 144 into the hard-surfaced pathway or the like, the ground or any adjacent objects. The vacuum dust collector 170, or at least the dust collector portion 253, is turned off and the flow of cooling fluid from the cooling fluid supply system 160 is shut off.

The trip hazard removing apparatus 106 or 206 is then raised away from the hard-surfaced pathway or the like. Typically, the vehicle 102 is then backed up away from the just-removed trip hazard so that the just-removed trip hazard is exposed and the trip hazard removing apparatus 106 or 206 is out of the way. This allows the operator to perform any final trimming or clean up of the trip hazard with the hand-held trip hazard trimming saw 300, as well as any dust clean-up with the sweeper portion 254. It should be appreciated that, as outlined above, the cut through the trip hazard can be extended to, or at least as close as possible to, any obstacles or barriers at the edges of the sidewalk by raising the dust control apparatus 150 or the blade portion 260 or any other blade guard or the like. This allows the saw blade 144 to travel closer to the object without interference.

It should be appreciated that the cargo bed 104 allows the trip hazard removing system 100 to be self contained and fully mobile and/or self-propelled, such that, once the vehicle 102 is transported to an area where a number of trip hazards to be removed are present, the vehicle 102 is able to move the entire trip hazard removing system 100 from one trip hazard to the next. Typically, in most communities in the U.S., sidewalks are about 5 feet in width. Thus, it should also be appreciated that the vehicle 102 desirably has a wheel or track base of 5 feet or smaller, so that it is easily able to travel on normal city sidewalks. The inventor has determined that, currently, the most effective vehicle 102 is a Bobcat® 5600 Toolcat®, as it is able to carry the trip hazard removing apparatus 106 or 206, the vacuum dust collector 170, the generator 190 and any desired accessories, such as the hand-held trip hazard trimming saw 300, various spare parts, and/or various replacement blades. It should also be appreciated that the Bobcat® 5600 Toolcat®, has sufficient hydraulic flow and power, as discussed above.

While this invention has been described in conjunction with the exemplary embodiments outlined above, various alternatives, modifications, variations, improvements and/or substantial equivalents, whether known or that are or may be presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The invention claimed is:

1. A method for removing a trip hazard from a planar sidewalk having at least one trip hazard, comprising:

driving a mobile, self-propelled and self-contained trip hazard removing machine on top of a planar sidewalk near a trip hazard to be removed;

positioning the mobile, self-propelled and self-contained trip hazard removing machine proximate to the trip hazard to be removed such that at least one guide rail straddles the planar sidewalk;

controllably lowering at least one lift arm provided at an end of the trip hazard removing machine to place a support structure, that is at least pivotably connected to the at least one lift arm, onto the sidewalk adjacent to and generally parallel to the trip hazard to be removed, such that a trip hazard engaging mechanism is adjacent to and in contact with the trip hazard, the trip hazard engaging mechanism automatically adjusting an orientation of the support structure relative to the at least one lift arm such that the support structure rests stably on the sidewalk adjacent to the trip hazard to be removed;

moving a hydraulically powered saw head, that is mounted to and movable along the at least one guide rail, the at least one guide rail at least pivotably connected to the support structure, and mounted to a saw blade having a plurality of teeth provided on an edge formed about the perimeter of the saw blade, the saw blade and associated teeth being provided in a first plane substantially parallel to the planar sidewalk, to a location along the at least one guide rail such that the edge of the saw blade is adjacent to and faces into a first side surface of the trip hazard which extends outside of a plane formed by the planar sidewalk; and moving the saw head along the at least one guide rail to cut away the trip hazard, such that the saw blade initially contacts and cuts into the first side surface of the trip hazard on the planar sidewalk, until the saw blade exits the trip hazard on the sidewalk from a second surface of the trip hazard, the second side surface of the trip hazard extends outside of the plane formed by the planar sidewalk.

2. A method for removing a trip hazard from a sidewalk having at least one trip hazard, comprising:

driving a mobile, self-propelled and self-contained trip hazard removing machine on top of a sidewalk near a trip hazard to be removed;

positioning the mobile, self-propelled and self-contained trip hazard removing machine proximate to the trip hazard to be removed such that at least one guide rail straddles the sidewalk;

controllably lowering at least one lift arm provided at an end of the trip hazard removing machine to place a support structure, that is at least pivotably connected to the at least one lift arm, onto the sidewalk adjacent to and generally parallel to the trip hazard to be removed, such that a trip hazard engaging mechanism is adjacent to and in contact with the trip hazard, the trip hazard engaging mechanism automatically adjusting an orientation of the support structure relative to the at least one lift arm such that the support structure rests stably on the sidewalk adjacent to the trip hazard to be removed;

moving a hydraulically powered saw head that is mounted to and movable along the at least one guide rail at least pivotably connected to the support structure, the saw head including a spindle having a saw blade mounted to the spindle and the saw blade having an edge formed about the perimeter of the saw blade and being provided in a first plane, to a location along the at least one guide rail such that the edge of the saw blade is adjacent to and faces into a first side surface of the trip hazard which extends along a plane different from the first plane; and moving the saw head along the at least one guide rail to cut away the trip hazard, such that the saw blade initially contacts and cuts into the first side surface of the trip hazard on the sidewalk and exits the trip hazard from a second surface of the trip hazard.

* * * * *